US008348098B2

(12) United States Patent
Brückner

(10) Patent No.: US 8,348,098 B2
(45) Date of Patent: Jan. 8, 2013

(54) DISPENSING DEVICE FOR DISPENSING A PLURALITY OF DIFFERENT PREPARATIONS

(75) Inventor: Erik Brückner, Hilden (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 1020 days.

(21) Appl. No.: 12/306,304

(22) PCT Filed: Mar. 9, 2007

(86) PCT No.: PCT/EP2007/002057

§ 371 (c)(1),
(2), (4) Date: Dec. 23, 2008

(87) PCT Pub. No.: WO2007/147457

PCT Pub. Date: Dec. 27, 2007

(65) Prior Publication Data

US 2009/0277928 A1 Nov. 12, 2009

(30) Foreign Application Priority Data

Jun. 23, 2006 (DE) ..... 10 2006 029 345

(51) Int. Cl.
*B67D 7/70* (2010.01)

(52) U.S. Cl. ..... 222/136; 222/85; 222/144; 222/168; 222/325; 222/383.1; 222/488; 239/61; 239/309; 239/310; 239/407

(58) Field of Classification Search ..... 222/85–86, 222/129, 132–142, 144, 144.5, 145.5, 145.7–145.8, 222/162, 167–168, 325–327, 383.1, 488; 239/61–62, 302–310, 398, 407, 413–414
See application file for complete search history.

(56) References Cited

U.S. PATENT DOCUMENTS

| | | | | | |
|---|---|---|---|---|---|
| 3,303,970 | A * | 2/1967 | Breslau et al. | ..... | 222/134 |
| 4,355,739 | A * | 10/1982 | Vierkotter | ..... | 222/134 |
| 4,838,457 | A * | 6/1989 | Swahl et al. | ..... | 222/48 |
| 5,152,431 | A * | 10/1992 | Gardner et al. | ..... | 222/136 |
| 5,332,157 | A * | 7/1994 | Proctor | ..... | 239/304 |
| 5,339,990 | A * | 8/1994 | Wilder | ..... | 222/135 |
| 5,370,275 | A * | 12/1994 | Mills et al. | ..... | 222/136 |
| 5,433,350 | A * | 7/1995 | Graubart | ..... | 222/136 |
| 5,634,571 | A * | 6/1997 | Cataneo et al. | ..... | 222/80 |
| 5,711,457 | A * | 1/1998 | Wanbaugh et al. | ..... | 222/136 |
| 5,819,987 | A * | 10/1998 | Miller | ..... | 222/135 |
| 5,857,591 | A | 1/1999 | Bachand | | |
| 5,947,335 | A * | 9/1999 | Milio et al. | ..... | 222/136 |
| 5,964,377 | A * | 10/1999 | Demarest et al. | ..... | 222/136 |
| 6,036,057 | A | 3/2000 | Poutiatine | | |
| 6,299,023 | B1 * | 10/2001 | Arnone | ..... | 222/94 |
| 6,739,779 | B1 * | 5/2004 | Deeds | ..... | 401/47 |
| 7,021,499 | B2 * | 4/2006 | Hansen et al. | ..... | 222/145.5 |
| 2002/0190139 | A1 * | 12/2002 | Morrison | ..... | 239/315 |

* cited by examiner

*Primary Examiner* — Kevin P Shaver
*Assistant Examiner* — Andrew P Bainbridge
(74) *Attorney, Agent, or Firm* — Connolly Bove Lodge & Hutz LLP

(57) ABSTRACT

A dispensing device dispenses at least two different preparations substantially simultaneously. The device has a delivery element to deliver a first preparation from a package to its surrounding environment when an actuating element, in at least one embodiment a trigger connected to a pump, is actuated. The dispensing device has a connection line between the delivery element and at least one portion cartridge for a second preparation. The portion cartridge is detachably coupled to the dispensing device such that as the actuating element is actuated, the first and second preparations can be simultaneously dispensed.

21 Claims, 12 Drawing Sheets

DISPENSING DEVICE FOR DISPENSING A PLURALITY OF DIFFERENT PREPARATIONS

RELATED APPLICATIONS

This application is a national stage application (under 35 U.S.C. §371) of PCT/EP2007/002057, filed Mar. 9, 2007, which claims benefit of German application 102006029345.2, filed Jun. 23, 2006.

The present invention relates to a dispensing device for essentially simultaneous dispensing of a plurality of different preparations, having a connection for detachable attachment of portion cartridges containing additives in particular.

STATE OF THE ART

There has long been a need to be able to individualize products on a customer-specific basis or to allow products to be individualized by the customer to a certain extent. An especially suitable medium for individualization of a product is a package because it forms the immediate interface between consumer and product.

It is therefore desirable to couple means for individualization or further functionalization of a product directly to the packaging of a product.

In the area of perfuming of products such as detergents, cleaning agents and the like in particular, it is customary at the present to finish an entire retail unit with a certain scent. However, users often want a different scent to be released by a cleaning product for different applications. For example, it is desirable for a cleaning agent for use in the toilet area to emit a stronger scent than in the living area, where strong fragrances are more often perceived as annoying. In the past, it has therefore been necessary to use a plurality of special cleaners with the corresponding fragrances, although the active cleaning preparations are each the same or at least very similar.

Especially with very aggressive cleaning preparations, there is also the problem that the aggressive cleaning components may destroy the fragrances or other active ingredients present in the preparations, so that they have only a low stability in storage.

To solve the problem of low stability in storage, multi-chambered containers have been proposed, in which compositions that are incompatible with one another are stored in separate spaces and are mixed together only at the time of application.

For convenient application of such cleaning preparations, in particular over a large area and/or to produce foam, dispensing devices in the form of trigger pumps, among others, are known.

For example, U.S. Pat. No. 5,857,591 describes a dispensing device for simultaneously spraying two different preparations. This document discloses a trigger pump which delivers preparations out of separate chambers of a bottle simultaneously, so that they can be dispensed to the environment through two spatially separate line systems, and the two preparations are not mixed until after the product is dispensed.

With this approach, there is the disadvantage that a multi-chambered bottle having a complex shape is used. The trigger pump disclosed in U.S. Pat. No. 5,857,591 also has the disadvantage that it does not allow a selection of preparations to be dosed together. Only the preparations in the two chambers can be sprayed in a certain mixing ratio to one another.

A dispensing device which can deliver a certain preparation out of a multi-chambered container is disclosed in U.S. Pat. No. 5,152,431. Said U.S. Pat. No. 5,152,431 discloses a trigger pump that is rotatably arranged on the closure of a multi-chambered bottle. An ascending tube extends from an adaptor plate into each of the chambers, which are filled with different compositions. By rotating the trigger pump, an inlet line on the intake side which is connected to the pump may be coupled to an ascending tube to communicate via the adaptor plate. It is possible in this way to electively spray a certain preparation from one of the chambers.

One disadvantage of this approach known from U.S. Pat. No. 5,152,431 is that production of such multi-chambered bottles is comparatively complicated and cost-intensive. Furthermore, through the proposed approach, only one certain preparation can be dosed at a time.

However, it is desirable to allow the user of such a dispensing bottle to freely select the preparations to be mixed together, to thereby provide a certain scent to the product being conveyed, for example, or to add other additive substances.

OBJECT OF THE INVENTION

The object of the present invention is therefore to create a dispensing device which overcomes the known disadvantages of the state of the art and allows simultaneous delivery of at least two different compositions in a manner that is convenient for the user, wherein one of the compositions is selectable by the user from a number of possibilities. Another object of the invention is to embody the dispensing device in such a way that it can be used without having to make design changes in the single-chambered bottles.

This object is achieved by the invention through a dispensing device having the features of Claim 1.

By spatially separating certain active ingredients (scent, enzymes, bleach, etc.) from a preparation and its portioned arrangement in the dispensing device, which can be implemented according to the invention, the product in the packaging means can be finished in a simple manner.

Thus an important advantage of the inventive dispensing device may be seen in the fact that the user may be provided with a large selection of self-selectable confection options for a product situated in the packaging means. Through standardization of the portion cartridges and their connection to the dispensing device, manufacturing costs can be kept low in comparison with approaches known from the state of the art.

Furthermore, the inventive dispensing device may be operated with only one delivery element for delivering the two different preparations from the portion cartridges and the packaging means, so that the structural complexity and therefore the cost expenditure can be kept low.

In addition, the portion cartridges provide assurance that there cannot be any physical contact between the user and the preparation in the cartridge when refilling the dispensing device.

Connection

The inventive dispensing device comprises a connection to which portion cartridges containing additive substance preparation can be detachably coupled.

In a preferred embodiment of the dispensing device, exactly one portion cartridge can be coupled to the connection. According to another embodiment of the invention, however, it is conceivable for the connection to be embodied in a design such that at least two portion cartridges are coupled to the connection simultaneously.

Delivery Element

A delivery element in the sense of this patent application comprises a device which is coupled to the operating element and is suitable for delivering a preparation out of the packaging means and into the environment.

The delivery element may be embodied as a pump in particular. The pump may be driven mechanically or electrically.

A pump may be selected from the group of displacement pumps, worm conveyors (archimedean screw), bellows pumps, piston pumps, rotary piston pumps, gearwheel pumps, diaphragm pumps, rotary slide pumps, hose pumps, toothed belt pumps, eccentric cam pumps, screw pumps, flow pumps, rotary pumps, axial pumps, diagonal pumps, foam pumps or radial pumps.

In a preferred embodiment of the invention, the delivery element may also be embodied as an aerosol package under pressure, such that the delivery element as such is embodied by the propellant of the aerosol package which is under pressure.

In another embodiment, the delivery element is embodied as a preferably elastically deformable container with which the increase in pressure in the interior or the packaging means, which is necessary to delivery the preparation out of the packaging means, is accomplished by a sudden squeezing of the lateral walls of the packaging means. In this case, the delivery element and the actuating element are embodied as a device, namely the squeezable container.

Packaging Means

A packaging means in the sense of this patent application is a device which is intended to enclose a preparation in such a way that it is suitable for shipping, storage and/or sale.

The packaging means usually has a bottom and a lateral surface by which a volume is shaped to receive a preparation. Furthermore, the packaging means usually has an opening for dispensing the preparation out of the packaging means, said opening being closable by a closure means. The closure means and the dispensing device may preferably be embodied as a component, for example, in the form of a coupling ring that is integrally molded on the dispensing device and is provided with an inside thread.

A packaging means may be selected in particular from the group of bottles, containers, cans, boxes, bags, etc.

For use with trigger dispensing devices or with dispensing devices that need a vertical stroke of the actuating element to dispense the product, it is advantageous with regard to the stability and/or strength of a such a packaging means system, for example, for the packaging means to be shaped as a container having a stable shape and/or volume in particular.

In a preferred embodiment of the invention, the packaging means is embodied to be squeezable. The packaging means may be embodied to be elastic in particular in such a manner that after squeezing has stopped, the packaging means is restored to its original shape before squeezing. Due to the squeezable shaping of the packaging means, it is possible to exert a sufficient pressure on the preparation in the packaging means which acts to dispense the preparation out of the packaging means to the environment. In this way, the packaging means may assume the function of the actuating element and the delivery element in particular.

In another embodiment of the invention, the packaging means is embodied as an aerosol package. In this case, a can or a bottle forms the pressure-resistant base body of the aerosol container, in which a liquid, pasty or powdered filling material which is under pressure from a propellant can be removed as a spray mist or a foam when an aerosol valve is operated.

The packaging means has a filling volume of 100 mL to 5000 mL, preferably 125 mL to 2000 mL, especially preferably 150 mL to 1500 mL, most especially preferably 175 mL to 1250 mL.

Actuating Element

An actuating element in the sense of this patent application is understood to be a device which is coupled directly or indirectly to the delivery element, resulting in a preparation being dispensed out of a packaging means due to operation of the actuating element by the user.

The actuating element may be embodied in particular as an articulated lever, for example, in the form of a trigger, operation of which is usually accomplished by an essentially horizontal movement of the free end of the lever.

It is also possible for the actuating element to be shaped as a pump dispenser, which usually has vertical kinetics of movement and operation.

In another preferred embodiment of the invention, the packaging means is shaped to be squeezable. Due to the squeezable shaping of the packaging means, it is possible to exert a sufficient pressure on the preparation in the packaging means, causing the preparation to be dispensed out of the packaging means to the environment. In this way the packaging means may assume the function of the actuating element and the delivery element in particular.

These actuating elements described in the introduction are sufficiently well known from the state of the art, so that they will not be discussed in greater detail here.

Receiving Element

In the sense of this patent application, the term receiving element is understood to refer to a device for receiving a plurality of portion cartridges.

In particular the receiving element may comprise a plurality of portion cartridges having preparations and filling volumes differing from one another.

The receiving element has a receiving capacity between 2 and 20 portion cartridges, preferably between 2 and 15 portion cartridges, especially preferably between 2 and 10 portion cartridges, most especially preferably between 2 and 6 portion cartridges.

The receiving element may be embodied in an especially preferred embodiment of the invention, as a revolver-type drum having a plurality of cartridge chambers arranged concentrically around the axis of rotation of the drum to receive one portion cartridge in each chamber. The portion cartridges may be fixedly or detachably connected to the receiving drum.

It is especially advantageous to configure the receiving drum and arrange it rotatably in the dispensing device in such a way that the portion cartridges arranged in the receiving drum can be coupled to the connection of the dispensing device by rotation of the receiving drum in the dispensing device.

The receiving drum may be prefabricated with portion cartridges whose additive preparations are tailored to a certain intended purpose, for example. However, it is also conceivable for the user to assemble the receiving drum according to a given use situation.

In another possible embodiment, the receiving element is embodied as a magazine having a cartridge chamber to receive a plurality of portion cartridges. The portion cartridges are arranged here essentially directly side by side and/or one above the other.

Furthermore, it is possible to embody the receiving element as a blister package in which the cavities of the blister form the portion cartridges and the blister strip is the actual receiving element.

For visual inspection of the filling level of the portion cartridges or the respective assembly of a portion chamber, the receiving element may comprise inspection windows or may be shaped from an at least partially transparent material.

Portion Cartridge

In the sense of this patent application, a portion cartridge is a packaging means for a preparation, containing at least one additive substance that is different from the preparation in the packaging means, said packaging means being shaped for coupling to the connection of the dispensing device.

The portionable additive product units packaged individually in a portion cartridge are detachably secured on the connection of the dispensing device by a suitable form-fitting, nonpositive or bonded connection. Especially preferred types of connections include snap-on connections, screw, plug or press connections and adhesive bonds.

The portion cartridges are each couplable individually by the user to the connection. It is especially convenient to arrange the portion cartridges which are couplable to the connection so they are removable on the dispensing device or the packaging means for the user, in particular being individually removable. For example, receiving elements in or on which the portion cartridges are detachably secured may be provided on the dispensing device or the packaging means, so that the user can remove them from the receiving element on the dispensing device or the bottle for use of a certain portion cartridge and may couple them to the connection.

To prevent manual replacement of individual portion cartridges from the connection by the user, a plurality of portion cartridges may be arranged in a receiving element, in which the coupling of a portion cartridge to the connection may then take place through a relative movement of the receiving element with respect to the connection, so that to replace a portion cartridge, it need no longer be removed from the dispensing device.

For visual inspection of the filling level, a portion cartridge may have an inspection window or may be manufactured from an at least partially transparent material.

In order for the forces acting on the portion cartridge at the connection during the insertion of a portion cartridge into a receiving element or when coupling a portion cartridge to the connection not to lead to deformation of the portion cartridge, which would increase the pressure on the preparation in the cartridge so that the preparation would unintentionally escape from the portion cartridge, the portion cartridge is therefore preferably shaped from a material having a stable shape and/or stable volume.

A portion cartridge may have a filling volume that allows a single dosing of the preparation containing the additive substance. This means that almost the total contents of the portion cartridge are mixed with the preparation delivered out of the packaging means by operation of the actuating element.

It is also conceivable for a portion cartridge to have a filling volume which allows multiple dosing of the preparation containing the additive substance, only a part of the contents of the portion cartridge being mixed with the preparation delivered from the packaging means by operation of the operating element.

To prevent the need for manual opening of the portion cartridge before use by the user or to provide mechanically complex opening devices in the dispensing device, according to another embodiment of the invention, the portion cartridge may comprise a closure which is embodied so that due to the vacuum created in the connection on operation of the delivery element and the vacuum created due to the flow in the intake line or the pressure line, at least some of the preparation is dispensed from the portion cartridge. To do so, the closure may be embodied as a diaphragm or a silicone valve, for example. Furthermore, the closure may be shaped so that the preparation is prevented from running out due to its surface tension and/or viscosity.

A portion cartridge has a filling volume of 1 mL to 200 mL, preferably 2 mL to 100 mL, especially preferably 2.5 mL to 50 mL, most especially preferably 3 mL to 25 mL.

The volume ratio of the portion cartridges to the packaging means is between 1:5000 and 1:20, preferably between 1:2500 and 1:25, especially preferably between 1:1750 and 1:50.

A portion cartridge coupled to the connection of the dispensing device may be connected directly to the delivery element, so that accurate dosing of the preparation from the portion cartridge is possible due to accurate setting of the pressure ratios. Furthermore, the preparations from the portion cartridge and the packaging means are mixed only immediately in or after the delivery element, thereby reducing the possible unwanted effects due to the reaction of the two preparations, e.g. in the form of deposits or gelling, which could cause blockage of the inlet lines.

To achieve an easier adaptation of the connection for portion cartridges without design changes in an existing delivery element, however, it is also conceivable for a portion cartridge to be embodied indirectly, i.e. via an existing inlet line with the delivery element. The preparation contained in the portion cartridge is then released, for example, by a Venturi effect, which creates a vacuum in the connection of the portion cartridge due to the flow of fluid in the line to the delivery element.

The portion cartridge may contain a preparation which forms an emulsion or suspension with the preparation contained in the packaging means. The portion cartridge may thus contain a solid in the form of a powder, for example, whereby the powder functions as a grinding body, for example.

The contents of the portion cartridges may consist of one or more products or additives that are the same or different, fragrances, cleaning substances, dyes, enzymes, hygroscopic substances and the like.

It would thus be conceivable, for example, to arrange substances with different fragrances in separate portion cartridges to allow different perfuming of the contents of the packaging means. For example, when using a scent-neutral cleaning fluid, each time product is dispensed from the packaging means, a scent may be dosed from another portion cartridge. This prevents olfactometric adaptation to a certain scent, but also a scent may be selected according to the requirements of a specific area of use (bathroom, living room, kitchen). In this case, it is no longer necessary to use several specially perfumed cleaning substances, which is also desirable from the standpoint of environmental protection and preserving resources, In addition, it is advantageous to provide acidic or alkaline solutions in the portion cartridges, so that the pH of the mixed preparation can be adjusted, in particular with an essentially neutral solution in the packaging means. Thus, for example, when using the inventive dispensing device for cleaning bath surfaces to remove lime deposits, it is conceivable to adjust a low pH, whereas when dissolving fat-based deposits, for example, a high pH may be selected through the choice of the corresponding portion cartridge.

Preparation

A preparation in the sense of this patent application is a liquid, pasty, gelatinous or powdered, deliverable substance or substance mixture.

The preparation may be present as a solution, mixture, emulsion or suspension of multiple substances.

Additive

The term additive in the sense of this patent application is understood to refer to a substance or substance mixture that is suitable for achieving or influencing a property of the product, in particular improving, producing, emphasizing, diminishing, accelerating or retarding a process over time, initiating, inhibiting or catalyzing a reaction by mixing it with the product in the container. Furthermore, an additive should also be understood to be a substance or a substance mixture that is suitable for achieving or influencing a property of the container, in particular the release of scent and/or active ingredient, adsorption or absorption in or on the container.

The additive may comprise, for example, one or more substances from the group of fragrances, bleaching agents, cleaning substances, solvents, surfactants, dyes, enzymes, hygroscopic substances, flame inhibitors, hardeners, flow control agents, wetting agents, dispersants, foaming agents, defoamers, deaerators, anticorrosion agents, biocides, water softeners, preservatives, emulsifiers, stabilizers, vitamins, minerals and the like.

Fragrances

Within the scope of the present invention, individual perfume compounds may be used as perfume oils and/or fragrances, e.g. the synthetic products of the type of esters, ethers, aldehydes, ketones, alcohols and hydrocarbons. Perfume substance compounds of the ester type include, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethylmethylphenyl glycinate, allylcyclohexyl propionate, styrallyl propionate and benzyl salicylate. The ethers include, for example, benzyl ethyl ether; the aldehydes include, for example, the linear alkanals with 8-18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethol, citronellol, eugenol, geraniol, linalool, phenylethyl alcohol and terpineol; the hydrocarbons include mainly the terpenes such as limonene and pinene. However, mixtures of various perfume substances that jointly produce an attractive scent note are preferred. Such perfume oils may also contain natural perfume substance mixtures such as those accessible from plant sources, e.g. pine oil, citrus oil, jasmine oil, patchouli oil, rose oil or ylang-ylang oil. Also suitable are muscatel, sage oil, chamomile oil, oil of cloves, melissa oil, mint oil, cinnamon oil, lime blossom oil, juniper berry oil, vetiver oil, frankincense oil, galbanum oil and labdanum oil as well as orange blossom oil, Neroli oil, orange peel oil and sandalwood oil.

The general description of the perfumes that may be used (see above) presents in general the various substance classes of perfume substances, To be perceptible, a perfume substance must be volatile, whereby in addition to the nature of the functional groups and the structure of the chemical compound, the molecular weight also plays an important role. For example, most perfume substances have molecular weights up to approximately 200 dalton, whereas molecular weights of 300 dalton or more are an exception. On the basis of the difference in volatility of perfume substances, the odor of a perfume and/or scent composed of several perfume substances changes during evaporation, so the odor impressions are subdivided into "top note," "middle note and/or body" and "end note and/or dry out." Since odor perception is based largely also on odor intensity, the top note of a perfume and/or scent is not made up only of readily volatile compounds while the end note comprises largely less volatile, i.e. adherent perfume substances. In the formulation of perfumes, more volatile perfume substances may be bound to certain fixatives, for example, to prevent so excessively rapid evaporation. In the subsequent classification of perfume substances as "readily volatile" or "adherent" perfume substances, nothing is said about whether the corresponding perfume substance is perceived as a top note or a middle note.

Through a suitable choice of the aforementioned fragrances and/or perfume oils, the product odor can be influenced directly on opening a product directly from the factory and the use scent can also be influenced in this way for inventive agents, e.g. when used in a dishwashing machine. These scent impressions may of course be identical, but they may also be different. For the latter odor impression, use of more adherent perfume substances is advantageous, whereas more volatile perfume substances may also be used for product scenting. Adherent perfumes which can be used within the scope of the present invention include, for example, the essential oils such as angelica root oil, anise oil, arnica blossom oil, basil oil, bay oil, bergamot oil, champaca blossom oil, pine oil, pine cone oil, elemi oil, eucalyptus oil, fennel oil, spruce needle oil, galbanum oil, geranium oil, ginger grass oil, guaiac oil, gurjun balsam oil, helichrysum oil, ho oil, ginger oil, iris oil, cajeput oil, calamus oil, chamomile oil, camphor oil, canaga oil, cardamom oil, cassia oil, scotch fir oil, copaiba balsam oil, coriander oil, spearmint oil, caraway oil, cumin oil, lavender oil, lemongrass oil, lime oil, mandarin oil, lemon balm oil, musk seed oil, myrrh oil, cloves oil, Neroli oil, niaouli oil, olibanum oil, orange oil, origanum oil, palmarosa oil, patchouli oil, Peru balsam oil, petitgrain oil, pepper oil, peppermint oil, pimento oil, pine oil, rose oil, rosemary oil, sandalwood oil, celery seed oil, spike lavender oil, star anise oil, turpentine oil, thuja oil, thyme oil, verbena oil, vetiver oil, juniper berry oil, vermouth oil, wintergreen oil, ylang-ylang oil, ysop oil, cinnamon oil, cinnamon leaf oil, citronella oil, lemon oil and cypress oil. However, the higher-boiling and/or solid perfume substances of natural or synthetic origin may also be used as adherent perfume substances and/or perfume substance mixtures, i.e. as fragrances within the scope of the present invention. These compounds include the compounds listed below as well as mixtures thereof: ambrettolide, α-amylcinnamaldehyde, anethol, anise aldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerate, borneol, bornyl acetate, α-bromostyrene, n-decylaldehyde, n-dodecylaldehyde, eugenol, eugenolmethyl ether, eucalyptol, farnesol, fenchone, fenchyl acetate, geranyl acetate, geranyl formate, heliotropin, heptinecarboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl β-napththyl ketone, methyl-n-nonylacetaldehyde, methyl n-nonyl ketone, muscone, β-naphtholethyl ether, β-naphtholmethyl ether, nerol, nitrobenzene, n-nonylaldehyde, nonyl alcohol, n-octylaldehyde, p-oxyacetophenone, pentadecanolide, β-phenylethyl alcohol, phenylacetaldehyde dimethylacetal, phenylacetic acid, pulegone, safrol, salicylic acid isoamyl ester, salicylic acid methyl ester, salicylic acid hexyl ester, salicylic acid cyclohexyl ester, santalol, scatol, terpineol, thyme, thymol, γ-undelactone, vanillin, veratrum aldehyde, cinnamaldehyde, cinnamyl alcohol, cinnamic acid, cinnamic acid ethyl ester, cinnamic acid benzyl ester. The more volatile perfume substances include in particular the low-boiling perfume substances of natural or synthetic origin, which may be used alone or in mixture. Examples of more readily volatile perfume substances include alkyl isothiocyanates (alkyl mustard oils), butanedione, limonene, linalool, linayl acetate and propionate, menthol, menthone, methyl-n-heptenone, phellandrene, phenylacetaldehyde, terpinyl acetate, citral, citronellal.

The plastic particles are preferably loaded with the selected scent at a temperature of 15° C. to 30° C., preferably from 20° C. to 25° C. To do so, the particles are mixed with the corresponding amount of scent and mixed thoroughly. In any case, the temperature should be below the melting point or the decomposition temperature of the plastic and should also be below the flashpoint of the perfume oil. The scent is primarily absorbed by the polymer carrier material through adhesion forces, diffusion forces and/or capillary forces or is absorbed by other perfume carrier materials contained in the particle, which then swell up slightly in the course of this process.

Other Active Substances

As mentioned above, inventive agents may also contain other substances in addition to the ingredients required for perfuming and deodorizing. Of the agents that serve exclusively for perfuming, thus additional product groups containing other preferred substances in addition to the inventive ingredients mentioned above may thus also be differentiated.

Dyes

The dyes are the first of these preferred optionally usable substances. Suitable here in general are all dyes with which those skilled in the art are familiar as being suitable for coloring plastics and/or as being soluble in perfume oils, It is preferable to select the dye according to the scent used; for example, particles with lemon scent preferably have a yellow color, whereas for particles with the scent of apples or herbs a green color is preferred. Preferred dyes have a high stability in storage and are insensitive to the other ingredients of the agents and to light. If the inventive agents are used in conjunction with cleaning of textiles or dishes, then the dyes that are used should not have a marked substantivity with respect to textile fibers, glass, plastic dishes or ceramics so as not to stain them.

Suitable dyes and dye mixtures are available commercially under various brand names and are offered by the companies, among others, BASF AG, Ludwigshafen, Bayer AG, Leverkusen, Clariant GmbH, DyStar Textilfarben GmbH & Co. Deutschland KG, Les Colorants Wackherr SA and Ciba. Suitable fat-soluble dyes and dye mixtures include, for example, Solvent Blue 35, Solvent Green 7, Solvent Orange 1 (Orange au Gras W-2201), Sandoplast Blue 2B, Yellow 3G, Iragon® Red SRE 122, Iragon® Green SGR 3, Solvent Yellow 33 and Solvent Yellow 16, but other dyes may also be included.

In a preferred embodiment, the dye not only has an aesthetic effect but also has an indicator function. In this way, the prevailing state of use of the deodorant is indicated to the consumer, so that in addition to the lack of a scent impression, which may also be based on a habituation effect on the part of the user, the consumer is given another reliable sign of when the deodorant is to be replaced by a new one.

The indicator effect may be achieved in various ways: first, a dye that escapes from the particles in the course of the duration of use may be used. This may be achieved, for example, by the ingredients contained in the dishwashing agent. To do so, a dye that adheres well to the particles and/or diffuses out of them slowly must be used to ensure that the decolorization will not be concluded too soon, namely when the scent has not yet been used up. On the other hand, however, a change in color may also be caused by a chemical reaction or thermal decomposition.

Antimicrobial Active Ingredients, Germicides, Fungicides

Other preferred ingredients of inventive agents include substances such as antimicrobial active ingredients, germicides, fungicides, antioxidants or corrosion inhibitors, with the help of which additional benefits such as disinfection or corrosion prevention can also be achieved.

To combat microorganisms, the inventive agents may contain antimicrobial active ingredients. A distinction is made here between the bacteriostatics and batericides, fungistatics and fungicides, etc., depending on the antimicrobial spectrum and the mechanism of action. Important substances from these groups include, for example, benzalkonium chlorides, alkylarylsulfonates, halophenols and phenolmercuriacetate.

Antioxidants

To prevent changes in the inventive agents or the treated textiles, for example, due to the action of oxygen and other oxidative processes, the agents may contain antioxidants. This class of compounds includes, for example, substituted phenols, hydroquinones, pyrocatechols and aromatic amines as well as organic sulfides, polysulfides, dithiocarbamates, phosphites and phosphonates.

If the inventive agents are used in dishwashing machines, these agents may contain corrosion inhibitors to protect the washed utensils or the machine, and silver protectants are especially important in the field of machine dishwashing. The known substances of the state of the art may be used. In general, silver protectants are selected mainly from the group of triazoles, benzotriazoles, bisbenzotriazoles, aminotriazoles, alkylaminotriazoles and the transition metal salts or complexes. Especially preferred for use here are benzotriazole and/or alkylaminotriazole. In addition, agents containing active chlorine, which can definitely reduce the corrosion of the silver surface, are often used in cleaning agent formulations. In chlorine-free cleaning agents, organic redox-active compounds containing oxygen and nitrogen are used in particular, such as divalent and trivalent phenols, e.g. hydroquinone, pyrocatechol, hydroxyhydroquinone, gallic acid, phloroglucine, pyrogallol and/or derivatives of these classes of compounds. Salt-like and complex-like inorganic compounds, such as salts of the metals Mn, Ti, Zr, Hf, V, Co and Ce are often used. The transition metal salts, which are selected from the group of manganese and/or cobalt salts and/or complexes are preferred here, especially preferably the cobalt-(ammine) complexes, the cobalt-(acetate) complexes, the cobalt-(carbonyl) complexes, the chlorides of cobalt or manganese and of manganese sulfate. Likewise, zinc compounds may also be used to prevent corrosion of the items being washed.

Instead of or in addition to the silver protectants described above, e.g. the benzotriazoles, redox-active substances may also be used in the inventive agents. These substances are preferably inorganic redox-active substances from the group comprising manganese, titanium, zirconium, hafnium, vanadium, cobalt and cerium salts and/or complexes, in which the metals are preferably present in one of the oxidation stages II, II, IV, V or VI.

The metal salts and/or metal complexes that are used should be at least partially soluble in water. The counterions that are suitable for forming a salt include all the conventional inorganic anions with one, two or three negative charges, e.g. oxide, sulfate, nitrate, fluoride as well as organic anions, e.g. stearate.

Metal complexes in the sense of the invention are compounds comprising one central atom and one or more ligands plus optionally one or more of the aforementioned anions in addition. The central atom is one of the aforementioned metals in one of the aforementioned oxidation states. The ligands are neutral molecules or anions having one or more teeth. The term "ligand" in the sense of the invention is explained in greater detail, e.g. in *Römpp Chemie Lexikon* [Römpp's Chemistry Lexicon], Georg Thieme Verlag Stuttgart/New York, 9th edition, 1990, page 2507. If the charge of the central atom and the charge of the ligand(s) in a metal complex do not complement one another to zero, then either one or more of the aforementioned anions or one or more of the cations, e.g. sodium, potassium, ammonium ions provide for the charge exchange, depending on whether there is an excess cationic charge or an excess anionic charge. Suitable complexing agents include, for example, citrate, acetylacetonate or 1-hydroxyethane-1,1-diphosphonate.

The definition of "oxidation state" conventionally used in chemistry is given, for example, in *Römpp Chemie Lexikon* [Römpp's Chemistry Lexicon] Georg Thieme Verlag Stuttgart/New York, $9^{th}$ edition, 1991, page 3168.

Especially preferred metal salts and/or metal complexes are selected from the group of $MnSO_4$ Mn(II) citrate, Mn(II) stearate, Mn(II) acetylacetonate, Mn(II) (1-hydroxyethane-1, 1-disphosphonate), $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ as well as their mixtures, so that preferred inventive agents are characterized in that the metal salts and/or metal complexes are selected from the group of MnSO4, Mn(II) citrate, Mn(II) stearate, Mn(II) acetylacetonate, Mn(II) (1-hydroxyethane-1,1 -disphosphonate), $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$.

These metal salts and/or metal complexes are generally conventional commercial substances that may be used in the inventive agents for the purpose of preventing silver corrosion without prior cleaning. For example, the mixture of pentavalent and tetravalent vanadium known from $SO_3$ production (contact process) ($V_2O_5$, $VO_2$, $V_2O_4$) is suitable, as is the titanyl sulfate $TiOSO_4$ formed by dilution of a $Ti(SO_4)_2$ solution.

The metal salts and/or metal complexes listed above are present in the inventive agents, preferably in an amount of 0.05 to 6 wt %, preferably 0.2 to 2.5 wt %, based on the total preparation.

Bleaching Agents

In addition to the active substances listed above, the inventive agents, in particular agents for use in dishwashing machines, clothes washing machines or dryers may of course contain all the active substances usually present in agents for cleaning clothes or dishes and/or for the care of fabrics or dishes, whereby especially preferred substances are those from the group of bleaching agents, bleach activators, polymers, builders, surfactants, enzymes, electrolytes, pH-adjusting agents, fragrances, perfume carriers, dyes, hydrotropes, foam inhibitors, antiredeposition agents, optical brighteners, graying inhibitors, shrinkage prevention agents, crease-resistant agents, dye transfer inhibitors, antimicrobial active ingredients, germicides, fungicides, antioxidants, corrosion inhibitors, antistatics, phobizing and impregnating agents, swell-proof and slip-proof agents, nonaqueous solvents, fabric softeners, protein hydrolyzates as well as UV absorbers. Such combination products are then also suitable for care or cleaning of textiles or dishes either once or many times in addition to the repeated perfuming.

Important ingredients of detergents or cleaning agents that may be present in addition to other ingredients in the inventive agents may include bleaching agents and bleach activators. Of the compounds that supply $H_2O_2$ in water and function as bleaching agents, sodium perborate tetrahydrate and sodium perborate monohydrate have gained a special importance. Other bleaching agents that may also be used include, for example, sodium percarbonate, peroxy pyrophosphates, citrate perhydrates and peracid salts that supply $H_2O_2$ or peracids such as perbenzoates, peroxophthalates, diperazelaic acid, phthaloimino peracid or diperdodecanedioic acid. Molded bodies of cleaning agent for dishwashing machines may also contain bleaching agents from the group of organic bleaching agents. Typical organic bleaching agents include diacyl peroxides, e.g. dibenzoyl peroxide. Other typical organic bleaching agents include the peroxy acids, where the alkyl peroxy acids and arylperoxy acids are mentioned as examples in particular. Preferred representatives that may be used include (a) peroxybenzoic acid and its ring-substituted derivatives such as alkylperoxybenzoic acids as well as peroxy-α-naphthoic acid and magnesium monoperphthalate, (b) the aliphatic or substituted aliphatic peroxy acids such as peroxylauric acid, peroxystearic acid, ε-phthalimido peroxycaproic acid [phthaloiminoperoxyhexanoic acid (PAP)], o-carboxybenzamidoperoxycaproic acid, N-nonenylamidoperadipic acid and N-nonenylamidopersuccinates and (c) aliphatic and araliphatic peroxydicarboxylic acids such as 1,12-diperoxycarboxylic acid, 1,9-diperoxyazelaic acid, diperoxy-sebacic acid, diperoxybrassylic acid, diperoxyphthalic acids, 2-decyldi-peroxybutane-1, 4-dioic acid, N,N-terephthaloyidi-(6-aminopercaproic acid).

If the inventive agents are used in combination with machine dishwashing agents, then they may contain bleach activators to achieve an improved bleaching effect in cleaning at temperatures of 60° C. or lower. Bleach activators that may be used include compounds which form aliphatic peroxocarboxylic acids preferably with 1 to 10 carbon atoms, in particular 2 to 4 carbon atoms, and/or optionally substituted perbenzoic acid under perhydrolysis conditions. Suitable substances are those having O- and/or N-acyl groups of the aforementioned number of carbon atoms and/or optionally substituted benzoyl groups. Polyacylated alkylenediamines are preferred, in particular tetraacetylethylenediamine (TAED), acylated triazine derivatives in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinamide (NOSI), acylated phenoisulfonates, in particular n-nonanoyl- or isononanoyloxybenzenesulfonate (n-NOBS and/or iso-NOBS), carboxylic acid anhydrides, in particular phthalic acid anhydride, acylated polyvalent alcohols, in particular triacetin, ethylene glycol diacetate and 2,5-diacetoxy-2,5-dihydrofuran.

Other bleach activators preferred for use within the scope of the present patent application include compounds from the group of cationic nitriles, in particular cationic nitriles of the formula

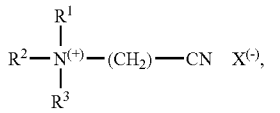

in which $R^1$ stands for H, $CH_3$, a $C_{2-24}$ alkyl or alkenyl radical, a substituted $C_{2-24}$ alkyl or alkenyl radical with at least one substituent from the group of Cl, Br, OH, $NH_2$, CN, an alkyl or alkenylaryl radical with a $C_{1-24}$ alkyl group or a substituted alkyl or alkenylaryl radical with a $C_{1-24}$ alkyl group and at least one additional substituent on the aromatic ring, $R^2$ and $R^3$ independently of one another are selected from $CH_2$—CN, $CH_3$, $CH_2$—$CH_3$, $CH_2$—$CH_2$—$CH_3$, $CH(CH_3)$—$CH_3$, $CH_2$—OH, $CH_2$—$CH_2$—OH, CH(OH)—$CH_3$, $CH_2$—$CH_2$—$CH_2$—OH, $CH_2$—CH(OH)—$CH_3$, CH(OH)—$CH_2$—$CH_3$, $(CH_2CH_2—O)_nH$, where n=1, 2, 3, 4, 5 or 6, and X is an anion.

In especially preferred inventive agents, a cationic nitrile of the formula

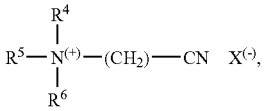

is present, in which $R^4$, $R^5$ and $R^6$ independently of one another are selected from $CH_3$, $CH_2$—$CH_3$, $CH_2$—$CH_2$—$CH_3$, $CH(CH_3)$—$CH_3$, where $R^4$ may also denote H, and X is an anion, where preferably $R^5$=$R^6$=$CH_3$ and in particular $R^4$=$R^5$=$R^6$=$CH_3$, and compounds of the formulas $(CH_3)_3N^{(+)}CH_2$—CN $X^-$, $(CH_3CH_2)_3N^{(+)}CH_2$—CN $X^-$, $(CH_3CH_2CH_2)_3N^{(+)}CH_2$—CN $X^-$, $(CH_3CH(CH_3))_3N^{(+)}$—$CH_2$—CN $X^-$ or $(HO—CH_2—CH_2)_3N^{(+)}CH_2$—CN $X^-$ are especially preferred, whereby in turn the cationic nitrile of the formula $(CH_3)_3N^{(+)}CH_2$—CN $X^-$, *in which* $X^-$ stands for an anion selected from the group including chloride, bromide, iodide, bisulfate, methosulfate, p-toluenesulfonate (tosylate) or xylenesulfonate, is especially preferred.

In addition to or instead of the conventional bleach activators, so-called bleach catalysts may also be incorporated into the agents. These substances are transition metal salts and/or transition metal complexes that have a bleach enhancing effect, such as Mn, Fe, Co, Ru or Mo-salene complexes or Mo-carbonyl complexes. Mn, Fe, Co, Ru, Mo, Ti, V and Cu complexes with N-containing tripod ligands as well as Co, Fe, Cu and Ru-ammine complexes may also be used as bleach catalysts.

Surfactants

Preferred agents within the scope of the present invention contain one or more surfactants from the groups of anionic, nonionic, cationic and/or amphoteric surfactants.

Preferably one or more substances from the group of carboxylic acids, sulfuric acid hemiesters and sulfonic acids, preferably from the group of fatty acids, fatty alkyl sulfuric acids and alkylarylsulfonic acids are used as the anionic surfactants in acid form. To have adequate surfactant properties, the aforementioned compounds should have longer-chain hydrocarbon radicals, i.e. there should be at least 6 carbon atoms in the alkyl or alkenyl radical. The carbon chain distributions of the anionic surfactants are usually in the range of 6 to 40, preferably 8 to 30 and in particular 12 to 22 carbon atoms.

Carboxylic acids, which are used in the form of their alkali metal salts as soaps in detergents and cleaning agents are mostly produced industrially from native fats and oils by hydrolysis. Whereas alkaline saponification, which was already being performed in the last century, led directly to alkali salts (soaps), today only water is used for cleavage on a large scale industrially, cleaving the fats into glycerol and free fatty acids. Methods used on a large scale industrially include, for example, cracking in autoclaves or continuous high-pressure cracking. Carboxylic acids that may be used as anionic surfactants within the scope of the present invention include, for example, hexanoic acid (caproic acid), heptanoic acid (enanthic acid), octanoic acid (caprylic acid), nonanoic acid (pelargonic acid), decanoic acid (capric acid), undecanoic acid, etc. Within the scope of the present invention, the use of fatty acids such as dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), hexacosanoic acid (cerotic acid), triacotanoic acid (melissic acid) as well as the unsaturated species 9c-hexadecenoic acid (palmitoleic acid), 6c-octadecenoic acid (petroselinic acid), 6t-octadecenic acid (petroselaidic acid), 9c-octadecenoic acid (oleic acid), 9t-octadecenoic acid (elaidic acid), 9c,12c-octadecadienoic acid (linoleic acid), 9t, 12t-octadecadienoic acid (linolaidic acid) and 9c,12c,15c-octadecatrienoic acid (linolenic acid). For cost reasons, it is preferable not to use the pure species but instead to use industrial mixtures of the individual acids such as those accessible from cracking of fats. Such mixtures include, for example, coconut oil fatty acid (approximately 6 wt % CB, 6 wt % $C_{10}$, 48 wt % $C_{12}$, 18 wt % $C_{14}$, 10 wt % $C_{16}$, 2 wt % $C_{18}$, 8 wt % $C_{18'}$, 1 wt % $C_{18''}$), palm kernel oil fatty acid (approximately 4 wt % $C_8$, 5 wt % $C_{10}$, 50 wt % $C_{12}$, 15 wt % $C_{14}$, 7 wt % $C_{16}$, 2 wt % $C_{18}$, 15 wt % $C_{18}$, 1 wt % $C_{18''}$), tallow fatty acid (approximately 3 wt % $C_{14}$, 26 wt % $C_{16}$, 2 wt % $C_{16}$, 2 wt % $C_{17}$, 17 wt % $C_{18}$, 44 wt % $C_{18'}$, 3 wt % $C_{18''}$, 1 wt % $C_{18''}$), hardened tallow fatty acid (approximately 2 wt % $C_{14}$, 28 wt % $C_{16}$, 2 wt % $C_{17}$, 63 wt % $C_{18}$, 1 wt % $C_{18'}$), technical-grade oleic acid (approximately 1 wt % $C_{12}$, 3 wt % $C_{14}$, 5 wt % $C_{16}$, 6 wt % $C_{16}$, 1 wt % $C_{17}$, 2 wt % $C_{18}$, 70 wt % $C_{18'}$, 10 wt % $C_{18''}$, 0.5 wt % $C_{18'''}$), technical-grade palmitic/stearic acid (approximately 1 wt % $C_{12}$, 2 wt % $C_{14}$, 45 wt % $C_{16}$, 2 wt % $C_{17}$, 47 wt % $C_{18}$, 1 wt % $C_{18'}$) and soybean oil fatty acid (approximately 2 wt % $C_{14}$, 15 wt % $C_{16}$, 5 wt % $C_{18}$, 25 wt % $C_{18'}$, 45 wt % $C_{18''}$, 7 wt % $C_{18'''}$)

Sulfuric acid hemiesters of longer-chain alcohols can also be used as anionic surfactants in their acid form and within the scope of the present invention. Their alkaline metal salts, in particular sodium salts, the fatty alcohol sulfates, are accessible on a large scale industrially from fatty alcohols, which are reacted with sulfuric acid, chlorosulfonic acid, amidosulfonic acid or sulfur trioxide to form the respective alkyl sulfuric acids and then are neutralized. The fatty alcohols are obtained from the respective fatty acids and/or fatty acid mixtures by high-pressure hydrogenation of the fatty acid methyl esters. The most important industrial process quantitatively for production of fatty alkyl sulfuric acids is sulfation of alcohols with $SO_3$/air mixtures in special cascade reactors, failing film reactors or tube bundle reactors.

Another class of anionic surfactant acids that may be used according to the invention are the alkyl ether sulfuric acids, whose salts, the alkyl ether sulfates, are characterized by a higher water solubility and lower sensitivity to water hardness (solubility of the Ca salts) in comparison with the alkyl sulfates. Alkyl ether sulfuric acids are synthesized from fatty alcohols like the alkyl sulfuric acids, which are reacted with ethylene oxide to yield the respective fatty alcohol methoxylates. Instead of ethylene oxide, propylene oxide may also be used. The subsequent sulfonation with gaseous sulfur trioxide in short-term sulfonation reactors gives yields of more than 98% of the respective alkyl ether sulfuric acids.

Alkanesulfonic acids and olefinsulfonic acids may also be used as anionic surfactants in acid form within the scope of the present invention. Alkanesulfonic acids may contain the sulfonic acid group with a terminal bond (primary alkanesulfonic acids) or along the C chain (secondary alkanesulfonic acids) but only secondary alkanesulfonic acids are of commercial importance. They are produced by sulfochlorination or sulfoxidation of linear hydrocarbons. In sulfochlorination according to Reed, n-paraffins are reacted with sulfur dioxide and chlorine under irradiation with UV light to yield the corresponding sulfochlorides, which form alkanesulfonates directly on hydrolysis with alkalis or yield alkanesulfonic acids when reacted with water. Since disulfochlorides, polysulfochlorides and chlorohydrocarbons may occur as byproducts of the free radical reaction in sulfochlorination, the reaction is usually performed only up to a 30% conversion and then is terminated.

Another process for synthesizing alkanesulfonic acids is sulfoxidation in which n-paraffins are reacted with sulfur dioxide and oxygen under irradiation with UV light. In this free radical reaction, alkylsulfonyl radicals are formed successively, reacting further with oxygen to yield alkylpersulfonyl radicals. The reaction with unreacted paraffin yields an alkyl radical and alkylpersulfonic acid, which breaks down into an alkylperoxysulfonyl radical and a hydroxyl radical. The reaction of the two radicals with unreacted paraffin yields alkylsulfonic acids and/or water, which reacts with alkylpersulfonic acid and sulfur dioxide to yield sulfuric acid. To keep the yield of the two end products alkylsulfonic acid and sulfuric acid as high as possible and to suppress side reactions, this reaction is usually performed only up to a conversion of 1% and then is terminated.

Olefinsulfonates are synthesized industrially by reaction of α-olefins with sulfur trioxide forming as intermediates zwitterions that cyclize to form so-called sultones. Under suitable conditions (alkaline or acidic hydrolysis), these sultones react to hydroxyalkanesulfonic acids and/or alkenesulfonic acids, both of which can also be used as anionic surfactant acids.

Alkylbenzenesulfonates are high-performance anionic surfactants which have been known since the 1930s. At that time, alkylbenzenes were synthesized by monochlorination of Kogasin fractions and subsequent Friedel-Crafts alkylation and then were sulfonated with fuming sulfuric acid and were neutralized with sodium hydroxide solution. At the beginning of the 1950s, propylene was tetramerized to branched α-dodecylene for synthesis of alkylbenzenesulfonates and the product was reacted by a Friedel-Crafts reaction using aluminum trichloride or hydrogen fluoride to yield tetrapropylenebenzene, which was subsequently sulfonated and neutralized. This economical possibility for synthesis of tetrapropylenebenzenesulfonates (TPS) led to a breakthrough for this class of surfactants, which subsequently displaced soaps as the main surfactant in detergents and cleaning agents.

Because of the inadequate biodegradability of TPS, there was a need to synthesize novel alkylbenzenesulfonates that would be characterized by improved ecological performance. These requirements are met by linear alkylbenzenesulfonates, which are the alkylbenzenesulfonates produced almost exclusively today and are known by the abbreviations ABS and/or LAS.

Linear alkylbenzenesulfonates are synthesized from linear alkylbenzenes, which are in turn accessible from linear olefins. This is done by separating on a large scale industrially petroleum fractions using molecular sieves into the n-paraffins of the desired purity and dehydrogenating these to the n-olefins, yielding both α-olefins and isoolefins. The resulting olefins are then reacted with benzene in the presence of acid catalysts to form the alkylbenzenes, where the choice of the Friedel-Crafts catalyst has an influence on the isomer distribution of the resulting linear alkylbenzenes. When using aluminum trichloride, the 2-phenyl isomer content in the mixture with the 3-, 4- and 5-isomers and other isomers is approximately 30 wt %, but when using hydrogen fluoride as the catalyst, the 2-phenyl isomer content can be reduced to approximately 20 wt %. Finally, sulfonation of the linear alkylbenzenes is successful on a large scale industrial today using fuming sulfuric acid, sulfuric acid or gaseous sulfur trioxide, but the latter is by far the most important. Sulfonation is performed using special film or tube bundle reactors which yield as the product a 97 wt % alkylbenzenesulfonic acid (ABSA) which can be used as an anionic surfactant acid within the scope of the present invention.

Through the choice of neutralizing agent, a wide variety of salts, i.e. alkylbenzenesulfonates, can be obtained from ABSA. For reasons of economy, it is preferable here to produce and use the alkali metal salts, of which the sodium salts of ABSA are preferred. These can be described by the general formula IX:

(IX)

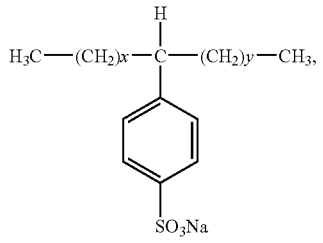

where the sum of x and y is usually between 5 and 13. Preferred as an anionic surfactant in acid form according to this invention are the $C_{8-16}$, preferably $C_{9-13}$-alkylbenzenesulfonic acids. It is also preferable within the scope of the present invention to use $C_{8-16}$, preferably $C_{9-13}$-alkylbenzenesulfonic acids, which are derived from alkylbenzenes having a tetralin content of less than 5 wt %, based on the alkylbenzene. It is also preferable to use alkylbenzenesulfonic acids in which the alkylbenzenes have been synthesized by the HF method, so that the $C_{8-16}$, preferably $C_{9-13}$-alkylbenzenesulfonic acids that are used have a 2-phenyl isomer content of less than 22 wt %, based on the alkylbenzenesulfonic acid.

The anionic surfactants in their acid form as mentioned above may be used either alone or in mixture with one another. However, it is also possible and preferable to add additional ingredients, preferably acidic ingredients of detergents and cleaning agents, to the anionic surfactant in acid form before it is added to the carrier material(s), said additional ingredients being added in amounts of 0.1 to 40 wt %, preferably from 1 to 15 wt % and in particular from 2 to 10 wt %, each based on the weight of the mixture to be reacted.

It is of course also possible to use the anionic surfactants in a partially or completely neutralized form. These salts may then be present as a solution, suspension or emulsion in the granulation fluid, but may also be present as a solid component of the solid bed. In addition to the alkali metals (here in particular as demanded and K salts) ammonium ions and mono-, di- or triethanolalkonium ions are suggested as cations for such anionic surfactants. Instead of mono-, di- or triethanolamine, the similar representatives of mono-, di- or triethanolamine and/or those of the alkanolamines of higher alcohols may also be present in quaternated form and as cations.

Cationic surfactants may also be used to advantage as the active substance. The cationic surfactant in its as-delivered form may be added directly into the mixer or it may be sprayed onto the solid carrier as a liquid-to-pasty cationic surfactant preparation form. Such cationic surfactant preparation forms can be produced, for example, by mixing conventional commercial cationic surfactants with additives such as nonionic surfactants, polyethylene glycols or polyols. Low alcohols such as ethanol and isopropanol may be used, but the amount of such low alcohols in the liquid cationic surfactant preparation form should be less than 10 wt % for the reasons given above.

All the conventional substances may be considered as the cationic surfactants for the inventive agents, but cationic surfactants with a textile softening effect are definitely preferred.

The inventive agents may contain one or more cationic textile softening agents of formulas X, XI or XII as the cationic active ingredients with a textile softening effect:

(X)

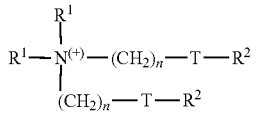

(XI)

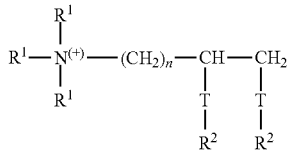

(XII)

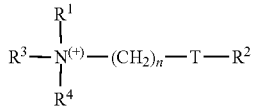

wherein each group $R^1$ independently of the others is selected from $C_{1-6}$-alkyl, alkenyl or hydroxyalkyl groups; each $R^2$ group independently of the others is selected from $C_{8-28}$-alkyl or alkenyl groups; $R^3$=$R^1$ or $(CH_2)_n$-T-$R^2$; $R^4$=$R^1$ or $R^2$ or $(CH_2)_n$-T-$R^2$; T=$CH_2$—, O—CO or CO—O and n is an integer from 0 to 5.

In preferred embodiments of the present invention, the means additionally contain nonionic surfactant(s) as active ingredient(s).

As nonionic surfactants, preferably alkoxylated, advantageously ethoxylated, in primary alcohols, preferably with 8 to 18 carbon atoms and an average of 1 to 12 mol ethylene oxide (EO) per mol alcohol are used; in these, the alcohol radical may be linear or preferably methyl-branched in position 2 and/or may contain linear and methyl-branched radicals in mixture, such as those usually found in residues. In particular, however, alcohol ethoxylates with linear radicals from alcohols of native origin with 12 to 18 carbon atoms, e.g. from coconut, palm or tallow fatty alcohol or oleyl alcohol and an average of 2 to 8 EO per mol alcohol are preferred. The preferred ethoxylated alcohols include, for example, $C_{12-14}$ alcohols with 3 EO or 4 EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures of these such as mixtures of $C_{12-14}$ alcohol with 3 EO and $C_{12-18}$ alcohol with 5 EO. The stated degrees of ethoxylation represent statistical means which may be an integral or fractional number for a specific product. Preferred alcohol ethoxylates have a narrow homolog distribution (narrow range ethoxylates, NRE). In addition to these nonionic surfactants, fatty alcohols with more than 12 EO may also be used. Examples of these include tallow fatty alcohol with 14 EO, 25 EO, 30 EO or 40 EO.

Furthermore, alkyl glycosides of the general formula $RO(G)_x$ in which R denotes a primary linear or methyl-branched aliphatic radical, in particular methyl-branched in position 2, having 8 to 22 carbon atoms, preferably 12 to 18 carbon atoms, and G is the symbol for a glycose unit having 5 or 6 carbon atoms, preferably glucose, may be used as additional nonionic surfactants. The degree of oligomerization x, which indicates the distribution of monoglycosides and oligoglycosides, may be any number between 1 and 10; x is preferably 1.2 to 1.4.

Another class of nonionic surfactants that are preferably used either alone as a nonionic surfactant or in combination with other nonionic surfactants are alkoxylated, preferably ethoxylated or ethoxylated and propoxylated fatty acid alkyl esters, preferably with 1 to 4 carbon atoms in the alkyl chain, in particular fatty acid methyl esters.

Nonionic surfactants of the amine oxide type that may also be suitable include N-coco-alkyl-N,N-dimethylamine oxide and N-tallow alkyl-N,N-dihydroxyethylamine oxide and the fatty acid alkanolamides. The amount of these nonionic surfactants is preferably no more than the amount of ethoxylated fatty alcohols, in particular no more than half thereof.

Other suitable surfactants include polyhydroxy fatty acid amides of formula XIII, (XIII)

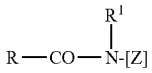

in which RCO stands for an aliphatic acyl radical with 6 to 22 carbon atoms, $R^1$ stands for hydrogen, an alkyl or hydroxyalkyl radical with 1 to 4 carbon atoms and [Z] stands for a linear or branched polyhydroxy alkyl radical with 3 to 10 carbon atoms and 3 to 10 hydroxyl groups. Polyhydroxy fatty acid amides are known substances which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of formula XIV, (XIV)

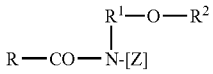

in which R stands for a linear or branched alkyl or alkenyl radical with 7 to 12 carbon atoms, $R^1$ stands for a linear, branched or cyclic alkyl radical or an aryl radical with 2 to 8 carbon atoms and $R^2$ stands for a linear, branched or cyclic alkyl radical or an aryl radical or an oxyalkyl radical with 1 to 8 carbon atoms, where $C_{1-4}$-alkyl or phenol radicals are preferred and [Z] stands for a linear polyhydroxy alkyl radical whose alkyl chain is substituted with at least two hydroxyl groups or alkoxylated, preferably ethoxylated or propoxylated derivatives of this radical.

[Z] is preferably obtained by reductive amination of a reduced sugar, e.g. glucose, fructose, maltose, lactose, galactose, mannose or xylose. The N-alkoxy-substituted or N-aryloxy-substituted compounds may then be converted to the desired polyhydroxy fatty acid amides by reaction with fatty acid methyl esters in the presence of an alkoxide as the catalyst.

It is especially preferred from many applications if the ratio of anionic surfactant(s) to nonionic surfactant(s) is between 10:1 and 1:10, preferably between 7.5:1 and 1:5 and in particular between 5:1 and 1:2. Preferred inventive containers contain surfactant(s), preferably anionic and/or nonionic surfactant(s), in amounts of 5 to 80 wt %, preferably 7.5 to 70 wt %, especially preferably from 10 to 60 wt % and in particular from 12.5 to 50 wt %, each based on the weight of the enclosed solids.

As already mentioned, the use of surfactants in cleaning agents for machine dishwashing is preferably limited to the use of nonionic surfactants in small amounts. Inventive agents for machine dishwashing therefore preferably contain only certain nonionic surfactants which are described below. Usually only low-sudsing nonionic surfactants are used as the surfactants in machine dishwashing agents. Representatives from the groups of anionic, cationic or amphoteric surfactants, however, have a lower significance here. Preferably used as nonionic surfactants are alkoxylated, advantageously ethoxylated, especially primary alcohols, preferably with 8 to 18 carbon atoms and an average of 1 to 12 mol ethylene oxide (EO) per mol alcohol, in which the alcohol radical may be linear or preferably methyl-branched in position 2 and/or linear and methyl-branched radicals may be present in the mixture such as those usually obtained in oxo alcohol residues. In particular, however, alcohol ethoxylates with linear radicals from alcohols of native origin with 12 to 18 carbon atoms, e.g. from coconut, palm, tallow fat or oleyl alcohol and an average of 2 to 8 EO per mol alcohol are preferred. The preferred ethoxylated alcohols include for example $C_{12-14}$ alcohols with 3 EO or 4 EO, $C_{9-11}$ alcohols with 7 EO, $C_{13-15}$ alcohols with 3 EOQ 5 EO, 7 EO or 8 EO, $C_{12-18}$ alcohols with 3 EO, 5 EO or 7 EO and mixtures of these as well as mixtures of $C_{12-14}$ alcohol with 3 EO and $C_{12-18}$ alcohol with 5 EO. The stated degrees of ethoxylation are statistical averages which may be an integral or fractional number for a specific product. Preferred alcohol ethoxylates have a narrow homolog distribution (narrow range ethoxylates, NRE). In addition to these nonionic surfactants, fatty alcohols with more than 12 EO may also be used. Examples of these include tallow fatty alcohol with 14 EO, 25 EO, 30 EO or 40 EO.

In particular in the case of cleaning agents for machine dishwashing, it is preferable if they contain a nonionic surfactant that has a melting point above room temperature, preferably a nonionic surfactant with a melting point above 20° C. Nonionic surfactants preferably used have melting points above 25° C., and nonionic surfactants that are especially preferably used have melting points between 25° C. and 60° C., in particular between 26.6° C. and 43.3° C.

Suitable nonionic surfactants having melting points and/or softening points in the aforementioned temperature range are, for example, low-sudsing nonionic surfactants which may be solid or may have a high viscosity at room temperature. If nonionics having a high viscosity at room temperature are used, it is preferable for them to have a viscosity above 20 Pas, especially above 35 Pas and in particular above 40 Pas. Nonionic surfactants having a waxy consistency at room temperature are also preferred.

Solid nonionic surfactants preferred for use as room temperature come from the groups of alkoxylated nonionics, in particular ethoxylated primary alcohols and mixtures of these surfactants with surfactants having a more complex structure, such as polyoxypropylene/polyoxyethylene/polyoxy-propylene (PO/EO/PO) surfactants. Such (PO/EO/PO) nonionic surfactants are also characterized by good control of sudsing.

In a preferred embodiment of the present invention, the nonionic surfactant with a melting point above room temperature is an ethoxylated nonionic derived from the reaction of a monohydroxyalkanol or alkylphenol with 6 to 20 carbon atoms with preferably at least 12 mol ethylene oxide, especially preferably at least 15 mol, in particular at least 20 mol ethylene oxide per mol alcohol and/or alkylphenol.

An especially preferred nonionic to be used that is solid at room temperature is obtained from a linear fatty alcohol with 16 to 20 carbon atoms ($C_{16-20}$ alcohol), preferably a $C_{1-8}$ alcohol and at least 12 mol, preferably at least 15 mol and in particular at least 20 mol ethylene oxide. Of these, the so-called "narrow range ethoxylates" (see above) are especially preferred.

The nonionic which is solid at room temperature preferably also has propylene oxide units in the molecule. Such PO units preferably constitute up to 25 wt %, especially preferably up to 20 wt % and in particular up to 15 wt % of the total molecular weight of the nonionic surfactant. Especially preferred nonionic surfactants are ethoxylated monohydroxyalkanols or alkylphenols which additionally have polyoxyethylene-polyoxypropylene block copolymer units. The alcohol and/or alkylphenol part of such nonionic molecules preferably constitutes more than 30 wt %, especially preferably more than 50 wt % and in particular more than 70 wt % of the total molecular weight of such nonionics.

Other preferred nonionics having melting points above room temperature that are to be used here contain 40% to 70% of a polyoxypropylene/polyoxyethylenelpolyoxypropylene block polymer blend which contains 75 wt % of an inverted block copolymer of polyoxyethylene and polyoxypropylene with 17 mol ethylene oxide and 44 mol propylene oxide and 25 wt % of a block copolymer of polyoxyethylene and polyoxypropylene, initiated with trimethylolpropane and containing 24 mol ethylene oxide and 99 mol propylene oxide per mol trimethylolpropane.

Nonionic surfactants that may be used to particular advantage are available under the brand name Poly Tergent® SLF-18 from the company Olin Chemicals, for example.

Another preferred surfactant can be described by the formula $$R^1O[CH_2CH(CH_3)O]_x[CH_2CH_2O]_y[CH_2CH(OH)R^2]$$

in which $R^1$ stands for a linear or branched aliphatic hydrocarbon radical with 4 to 18 carbon atoms or mixtures thereof $R^2$ stands for a linear or branched hydrocarbon radical with 2 to 26 carbon atoms or mixtures thereof and x stands for values between 0.5 and 1.5 and y has a value of at least 15.

Other preferred nonionics for use include the end-group-capped poly(oxyalkylated) nonionics of the formula $$R^1O[CH_2CH(R^3)O]_x[CH_2]_kCH(OH)][CH_2]_jOR^2$$

in which $R^1$ and $R^2$ stand for linear or branched saturated or unsaturated aliphatic or aromatic hydrocarbon radicals with 1 to 30 carbon atoms, $R^3$ stands for H or a methyl, ethyl, n-propyl, isopropyl, n-butyl, 2-butyl or 2-methyl-2-butyl radical, x stands for values between 1 and 30, k and j stand for values between 1 and 12, preferably between 1 and 5. If $x \geqq 2$, then any $R^3$ in the above formula may be different. $R^3$ and $R^2$ are preferably linear or branched, saturated or unsaturated, aliphatic or aromatic hydrocarbon radicals with 6 to 22 carbon atoms, whereby radicals with 8 to 18 carbon atoms are especially preferred. For the $R^3$ radical, H, $CH_3$ or $CH_2CH_3$ is especially preferred. Especially preferred values for x are in the range of 1 to 20, in particular 6 to 15.

As described above, any $R^3$ in the above formula may be different if $x \geqq 2$. The alkylene oxide unit in the square brackets may be varied in this way. For example, if x stands for 3, then the $R^3$ radical may be selected to form ethylene oxide ($R^3$=H) or propylene oxide ($R^3$=$CH_3$) units which may be aligned in any order, e.g. (EO)(PO)(EO), (EO)(EO)(PO), (EO)(EO)(EO), (PO)(EO)(PO), (PO)(PO)(EO) and (PO)(PO)(PO). The value 3 for x has been selected here as an example and may easily be larger in which case the range of variation increases with an increase in x values and includes for example a large number of (EO) groups combined with a small number of (PO) groups.

Especially preferred end-group-capped polyoxy alkylated alcohols of the formula given above have values of k=1 and j=1, so that the formula above is simplified to $$R^1O[CH_2CH(R^3)O]_xCH_2CH(OH)CH_2OR^2.$$

In the formula above, $R^1$, $R^2$ and $R^3$ have the meanings defined above and x stands for numbers from 1 to 30, preferably from 1 to 20 and in particular from 6 to 18. Surfactants in which the $R^1$ and $R^2$ radicals have 9 to 14 carbon atoms, $R^3$ stands for H and x assumes values of 6 to 15 are especially preferred.

Enzymes

Inventive agents may contain enzymes to increase the detergent power and/or cleaning power, whereby in principle all enzymes established for these purposes in the state of the art may be used. These include in particular proteases, amylases, lipases, hemicellulases, cellulases or oxidoreductases as well as preferably mixtures thereof These enzymes are in principle of natural origin; starting from the natural molecules, improved variants are available for use in detergents and cleaning agents and are preferably used accordingly. Inventive agents contain enzymes preferably in total amounts of $1\times10^{-6}$ to 5 wt % based on active protein. The protein concentration may be determined with the help of known methods, e.g. the BCA method (bicinchonic acid; 2,2'-biquinolyl-4,4'-dicarboxylic acid) or the biuret method.

Of the proteases, those of the subtilisin type are preferred. Examples include subtilisins BPN' and Carlsberg, protease BP92, subtilisins 147 and 309, the alkaline protease from *Bacillus lentus*, subtilisin DY and the enzymes thermitase, protein kinase and the proteases TW3 and TW7 which are to be assigned to the subtilases but are no longer classified as subtilisins in the narrower sense. In a further developed form, subtilisin Carisberg is distributed under the brand name Alcalase® by the company Novozymes A/S, Bagsvaerd, Denmark. Subtilisins 147 and 309 are distributed by the company Novozymes under the brand names Esperase® and/or Savinase®. Variants carried under the brand name BLAP® are derived from the protease from *Bacillus lentus* DSM 5483.

Other usable proteases include, for example, the enzymes available under the brand names Durazym®, Relase®, Everlase®, Nafizym, Natalase®, Kannase®) and Ovozymes® from the company Novozymes, the enzymes available under the brand names Purafect®, Purafect® OxP and Properase® from the company Genencor, the enzyme available under the brand name Protosol® from the company Advanced Biochemicals Ltd., Thane, India, the enzyme available and the brand name Wuxi® from the company Wuxi Snyder Bioproducts Ltd., China, the enzymes available under the brand names Proleather® and Protease P® from the company Amano Pharmaceuticals Ltd., Nagoya, Japan and the enzyme available under the brand name Proteinase K-16 from the company Kao Corp., Tokyo, Japan.

Examples of amylases that may be used according to this invention include the α-amylases from *Bacillus licheniformis, B. amyloliquefaciens* or *B. stearothermophilus* as well as further developments thereof that have been improved for use in detergents and cleaning agents. The enzyme from *B. licheniformis* is available from the company Novozymes under the name Termamyl® and from the company Genencor under the name Purastar®ST. Further development products of these α-amylases are available from the company Novozymes under the brand names Duramyl® and Termamyl®ultra, from the company Genencor under the name Purastar®OxAm and from the company Daiwa Seiko Inc., Tokyo, Japan is Keistase®. The α-amylase from *B. amyfoliquefaciens* is distributed by the company Novozymes under the name BAN® and derived variants of α-amylase from *B. sterothermophilus* are available under the names BSG® and Novamyl®, again from the company Novozymes.

In addition, the α-amylase from *Bacillus* sp. A 7-7 (DSM 12368) and the cyclodextrin glucanotransferase (CGTase) from *B. agaradherens* (DSM 9948) are to be emphasized for this purpose; likewise, fusion products of the aforementioned molecules may also be used.

In addition, the further developments of the α-amylase from *Aspergillus niger* and *A. oryzae* available under the brand name Fungamyl® from the company Novozymes are also suitable. Another commercial product is, for example, Amylase-LT®.

Inventive agents may contain lipases or cutinases, in particular because of their triglyceride-cleaving activities, but also to produce peracids in situ from suitable precursors. These include, for example, the lipases that are obtainable originally from *Humicola lanuginosa* (*Thermomyces lanuginosus*) and/or have been further developed, in particular those with the amino acid exchange D96L. They are distributed, for example, by the company Novozymes under the brand names Lipolase®, Lipolase®Ultra, LipoPrime®, Lipozyme® and Lipex®. In addition, for example, the cutinases originally isolated from *Fusarium solani pisi* and *Humicola insolens* may also be used. Other usable lipases are available from the company Amano under the brand names Lipase CE®, Lipase P®, Lipase B® and/or Lipase CES®, Lipase AKG®, *Bacillis* sp. Lipase®, Lipase AP®, Lipase M-AP® and Lipase AML®. For example, the lipases and/or cutinases whose starting enzymes were originally isolated from *Pseudomonas mendocina* and *Fusarium solanii* from the company Genencor may also be used. Other important commercial products that should also be mentioned include the preparations M1 Lipase® and Lipamax® originally distributed by the company Gist-Brocades and the enzymes distributed by the company Meito Sangyo KK, Japan under the names Lipase MY-30®, Lipase OF® and Lipase PL®, along with the product Lumafast® from the company Genencor.

Inventive agents may contain cellulases, in particular when they are intended for treatment of textiles, either as pure enzymes, as enzyme preparations or in the form of mixtures in which the individual components advantageously supplement one another with regard to their different performance aspects, depending on the intended purpose. These performance aspects include in particular contributions to the primary detergent power, secondary detergent power of the agent (antiredeposition effect or graying inhibition) and finishing (fabric effect) to having of a "stone-washed" effect.

A usable fungal cellulase preparation with a high endoglucanase (EG) content and/or further developments thereof are available from the company Novozymes under the brand name Celluzyme®). The products Endolase® and Carezyme® also available from the company Novozymes are based on the 50 kD EG, and/or the 43 kD EG from *H. insolens* DSM 1800. Other possible commercial products from this company include Cellusoft® and Renozyme®. Likewise the 20 kD EG cellulase from Melanocarpus available from the company AB Enzymes, Finland, under the brand names Ecostone® and Biotouch® may also be used. Other commercial products of the company AB Enzymes include Econase® and Ecopulp®. Another suitable cellulase from *Bacillus* sp. CBS 670.93 is available from the company Genencor under the brand name Puradax®. Other commercial products from the company Genencor include "Genencor detergent cellulase L" and IndiAge®Neutra.

Inventive agents may also contain other enzymes that are combined under the term hemicellulases. These include, for example, mannanases, xanthan lyases, pectin lyases (=pectinases), pectin esterases, pectate lyases, xyloglucanases (=xylanases), pullulanases and β-glucanases. Suitable mannanases are available for example under the names Gamanase® and Pectinex AR® from the company Novozymes, under the name Rohapec®B1L from the company AB Enzymes and under the name Pyrolase® from the company Diversa Corp., San Diego, Calif., USA. The β-glucanase obtained from *B. subtilis* is available under the name Cereflo® from the company Novozymes.

To increase the bleaching effect, inventive detergents or cleaning agents may contain oxidoreductases, e.g. oxidases, oxygenases, catalases, peroxidases such as halo-, chloro-, bromo-, lignin, glucose or manganese peroxidases, dioxygenases or laccases (phenol oxidases, polyphenol oxidases). Suitable commercial products include Denilite® 1 and 2 from the company Novozymes. Advantageously, preferably organic, especially preferably aromatic compounds that interact with the enzymes are also added to enhance the activity of the respective oxidoeductases (enhancers) or to ensure the flow of electrons when there are extremely different redox potentials between the oxidizing enzymes and the soiling (mediators).

The enzymes used in the inventive agents originate either originally from microorganisms, e.g. those of the genera *Bacillus, Streptomyces, Humicola* or *Pseudomonas* and/or are produced by suitable microorganisms using essentially known biotechnological methods, e.g. by transgenic expression hosts of the *Bacillus* genus or filamentary fungi.

The respective enzymes are advantageously purified by essentially established methods, e.g. by precipitation, sedimentation, concentration, filtration of the liquid phases, microfiltration, ultrafiltration, treatment with chemicals, deodorizing or suitable combinations of these steps.

The enzymes may be added to the inventive agents in any form established according to the state of the art. These include, for example, the solid preparations obtained by granulation, extrusion or lyophilization or, in particular in the case of liquid or gelatinous agents, solutions of the enzymes, advantageously as concentrated as possible, with a low water content and/or mixed with stabilizers.

As an alternative, the enzymes may also be encapsulated for both the solid and liquid dosage forms, e.g. by spray drying or extrusion of the enzyme solution together with a polymer, preferably natural, or in the form of capsules, e.g. those in which the enzymes are enclosed as in a solidified gel or in those of the core-shell type in which a core containing enzyme is coated with a protective layer that is impermeable to water, air and/or chemicals. Other active ingredients, e.g. stabilizers, emulsifiers, pigments, bleaches or dyes may additionally be applied in added layers. Such capsules are applied by essentially known methods, e.g. by shake granulation or rolling granulation or in fluidized-bed processes. Such granules are advantageously stable in storage, e.g. due to the application of polymeric film-forming agents, while having a low dust content and being stable in storage due to the coating.

In addition, it is possible to formulate two or more enzymes together so that a single granule has multiple enzyme activities.

A protein and/or enzyme contained in an inventive agent may be protected especially during storage against damage, e.g. due to inactivation, denaturing or decomposition, e.g, due to physical influences, oxidation or proteolytic cleavage. In the case of microbial production of the proteins and/or enzymes, inhibition of proteolysis is especially preferred, in particular when the agents also contain proteases. Inventive agents may contain stabilizers for this purpose; providing such means constitutes a preferred embodiment of the present invention.

Reversible protease inhibitors are one group of stabilizers. Benzamidine hydrochloride, borax, boric acids, boronic acids or their salts or esters are often used, including in particular derivatives with aromatic groups, e.g. ortho-, meta- or para-substituted phenylboronic acids and/or their salts or esters. In addition, peptide aldehydes, i.e. oligopeptides with a reduced C terminus are also suitable. Suitable peptidic protease inhibitors that may be mentioned include ovomucoid and leupeptin; another option is to form fusion proteins of proteases and peptide inhibitors.

Additional enzyme stabilizers include amino alcohols such as mono-, di-, triethanol and -propanolamine and mixtures thereof, aliphatic carboxylic acids up to $C_{12}$ such as succinic acid, other dicarboxylic acids or salts of the aforementioned acids. End-group-capped fatty acid amide alkoxylates may also be used as stabilizers.

Low aliphatic alcohols, but especially polyols, e.g. glycerol, ethylene glycol, propylene glycol or sorbitol or other commonly used enzyme stabilizers. In addition, diglycerol phosphate also protects against denaturing due to physical influences. Likewise, calcium salts are used such as calcium acetate or calcium formate as well as magnesium salts.

Polyamide oligomers or polymeric compounds such as lignin, water-soluble vinyl copolymers or such as cellulose ethers, acrylic polymers and/or polyamides stabilize the enzyme preparations with respect to physical influences or fluctuations in pH, among other things. Polymers containing polyamide N-oxide act as enzyme stabilizers and as dye transfer inhibitors at the same time. Other polymeric stabilizers include the linear $C_8$-$C_{18}$ polyoxyalkylenes. Akylpolyglycosides may also stabilize the enzymatic components of the inventive agent and may even increase their performance. Cross-linked compounds containing nitrogen fulfill a double function as soil release agents and as enzyme stabilizers.

Reducing agents and antioxidants such as sodium sulfite or reducing sugars increase the stability of the enzymes with respect to oxidative degradation.

Combinations of stabilizers are preferred for use, e.g. polyols, boric acid and/or borax, the combination of boric acid or borate, reducing salts and succinic acid or other dicarboxylic acids or the combination of boric acid or borate with polyols or polyamino compounds and with reducing salts. The effect of peptide-aldehyde stabilizers can be enhanced by the combination with boric acid and/or boric acid derivatives and polyols and can be further enhanced by the additional use of divalent cations such as calcium ions.

Especially preferred within the scope of the present invention is the use of liquid enzyme formulations. Inventive agents are preferred here, additionally containing enzymes and/or enzyme preparations, preferably solid and/or liquid protease preparations and/or amylase preparations in amounts of 1 to 5 wt %, preferably 1.5 to 4.5 wt %, and in particular 2 to 4 wt %, each based on the total means.

A wide number of a large variety of salts may be used as a electrolytes from the group of inorganic salts. Preferred cations include the alkali and alkaline earth metals; preferred anions are the halides and sulfates. From the standpoint of manufacturing technology, use of NaCl or $MgCl_2$ in the inventive granules is preferred.

DESCRIPTION OF THE PREFERRED EMBODIMENTS

Figure 1:
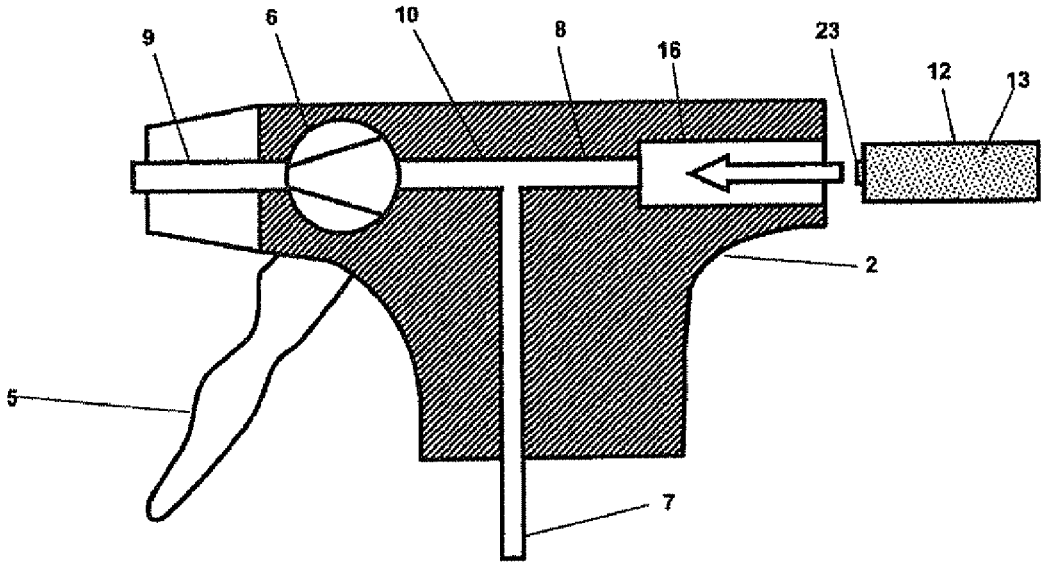
FIG. 1 Dispensing device with a horizontal receiving shell for portion cartridges in a cross-sectional view.
Figure 2:
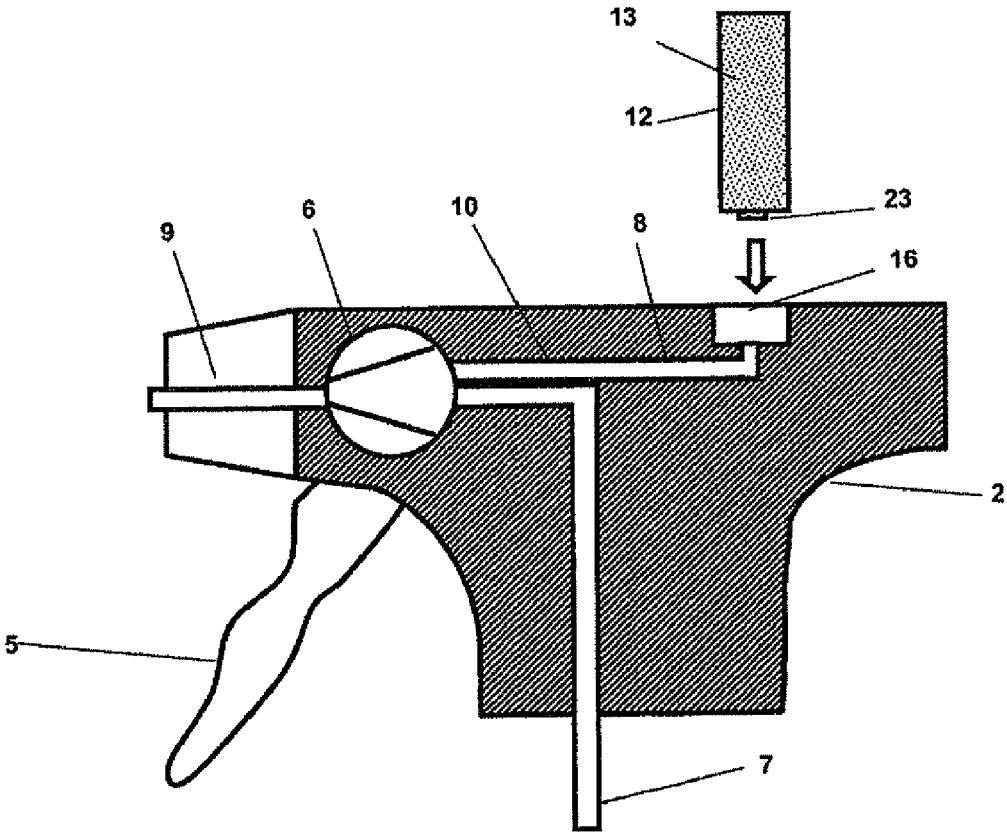
FIG. 2 Dispensing device with vertical receiving shell for portion cartridges in a cross-sectional view.

FIGS. 1 and 2 disclose the simplest embodiments of the invention technically. FIG. 1 shows a dispensing device 2 with a pump 6 integrated into the dispensing device 2. The pump 6 is coupled to an actuating element 5 embodied as an articulated lever. Operation of the actuating element 5 by pulling the free lever end toward the dispensing device produces a pump stroke of the pump 6. Those skilled in the art would couple the actuating element 5 to the pump 6 with coupling means that are sufficiently well known in the state of the art, in particular mechanical or electric coupling means.

A pressure line 9 is connected to the pump 6 on the pressure side and an intake line 10 is connected on the intake side. The intake line 10 is connected to the ascending tube 7 or develops into the ascending tube 7.

Figure 3:
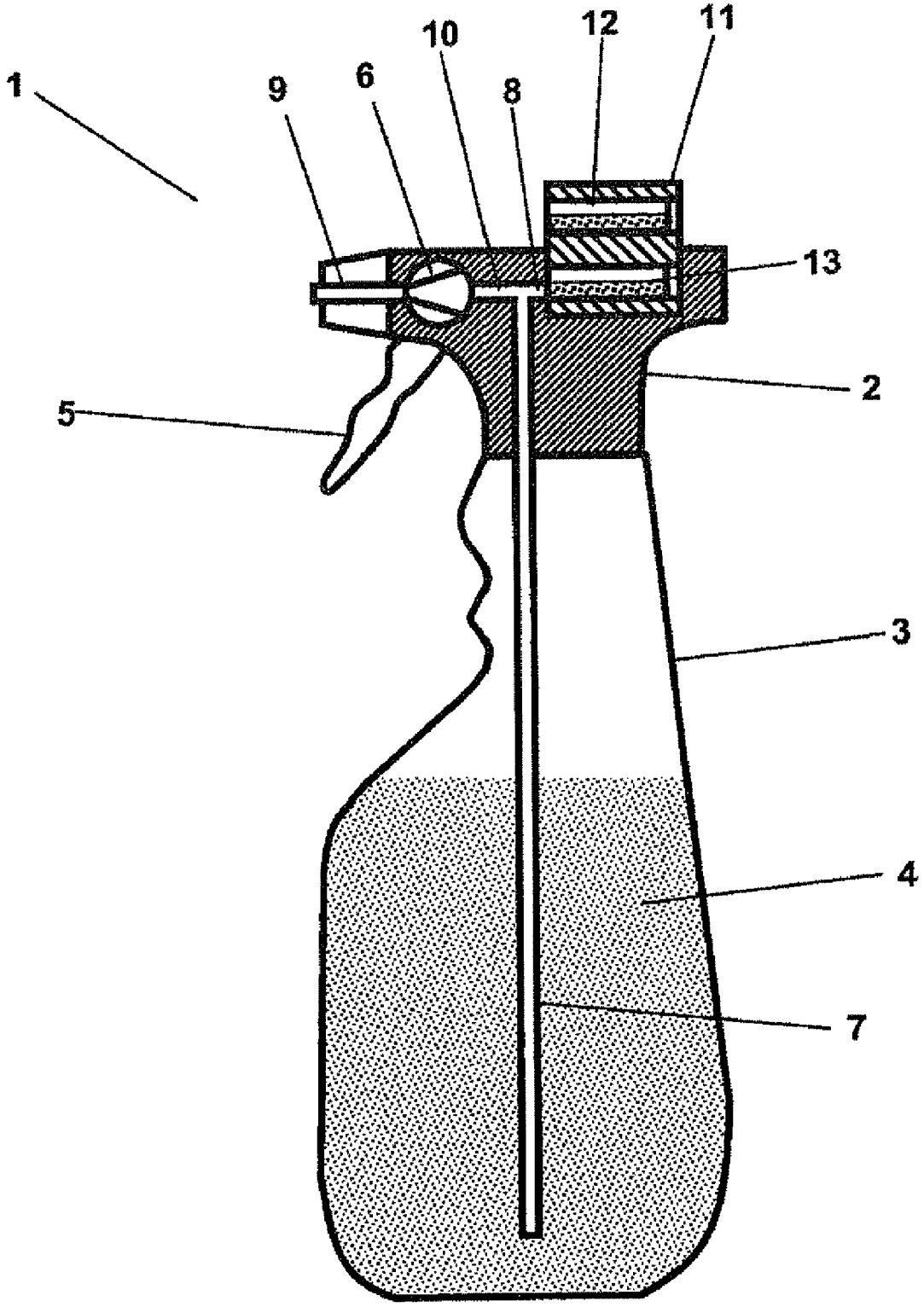
FIG. 3 Packaging means system with a receiving element for portion cartridges on the intake side of the delivery element in the cross-sectional view.

A connection 8 which is connected communicatingly to the intake line 10 is embodied on the intake line 10. As shown in FIG. 3, it is also possible for the connection 8 to be connected directly to the intake side of the pump 6.

The end of the connection 8 facing away from the intake line 10 opens in a receptacle 16 into which a portion cartridge 12 can be inserted horizontally and can be coupled to the connection 8 by means of the mouthpiece 23, so that with a pump stroke of the pump 6, the preparation 13 which is in the portion cartridge 12 is at least partially dispensed to the environment through the intake line 10 and the pressure line 9.

The preparation 13 is dispensed essentially due to the vacuum and/or flow created by one pump stroke in the intake line 10, thereby entraining the preparation 13 out of the portion cartridge 12. The amount of entrained preparation 13 per pump stroke of the pump 6 can be influenced in particular by the technical flow design of the connection 8 and the flow properties of the preparation 13.

FIG. 2 shows the dispensing device 2 known from FIG. 1 with a receptacle 16 in which a portion cartridge 12 can be secured vertically. The vertical positioning of the portion cartridge 12 has the advantage that preparation 13 is always ready at the connection 8 as long as the portion cartridge 12 is filled with a preparation 13. Furthermore, the filling level, in particular in the case of a transparent embodiment of the lateral surface of the cartridge 12, is easy to read, in particular when the cartridge 12 has a corresponding scale on the lateral surface.

As already mentioned above, the receptacle 16 and the connection 8 are connected directly to the pump 6 via the intake line 10, so that the dispensing of preparation 13 out of the portion cartridge 12 is not induced by a Venturi effect of the fluid conveyed through the ascending tube 7, as is known from FIG. 1. Thus the preparations 13 and 4 are not already mixed in the intake line 10 but instead are mixed only shortly before and/or in the pump 6. This may be advantageous inasmuch as no unwanted reaction products can flow back through the ascending tube 7 into the packaging means 3 due to a possible reaction of the two preparations 13 and 4.

Figure 7:
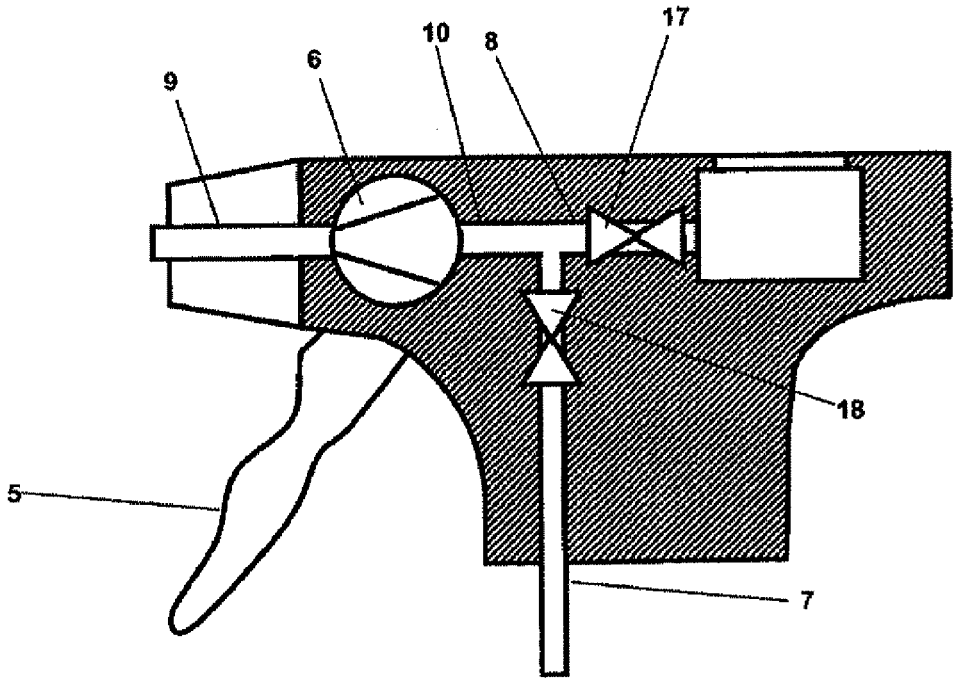
FIG. 7 Dispensing device with valve arrangement in the cross-sectional view.

Unwanted mixing of the preparations 13 and 4 with one another may also be implemented by an arrangement of valves, as shown in FIG. 7 as an example.

A non-return valve 18 is arranged here in the upper area of the ascending tube 7 which automatically blocks the passage of the preparation 4 being delivered against the direction of delivery of the preparation 4 and thus prevents liquid that has already been mixed with preparation 13 from flowing back into the packaging means 3. Furthermore, it is possible to provide another non-return valve 17 in the connection 8 or in the portion cartridge 12 so that unwanted mixing of the preparation 13 which is in the portion cartridge 12 with the preparation 4 is additionally suppressed.

As shown in FIG. 3, the dispensing device 2 known from FIG. 1 and/or FIG. 2 can be placed on a packaging means 3 with a seal, thereby forming a corresponding packaging means system 1 for simultaneous dispensing of at least two preparations 13 and 4.

The packaging means 3 is shaped as a bottle and the dispensing device 2 is shaped as a trigger spray head. The ascending tube 7 of the dispensing device 2 runs through the filling volume of the bottle 3 and opens into the pumpable preparation 4. In pumping, the preparation 4 is delivered into the environment successively through the ascending tube 7, the intake line 10, the pump 6 and the pressure line 9.

Figure 4:
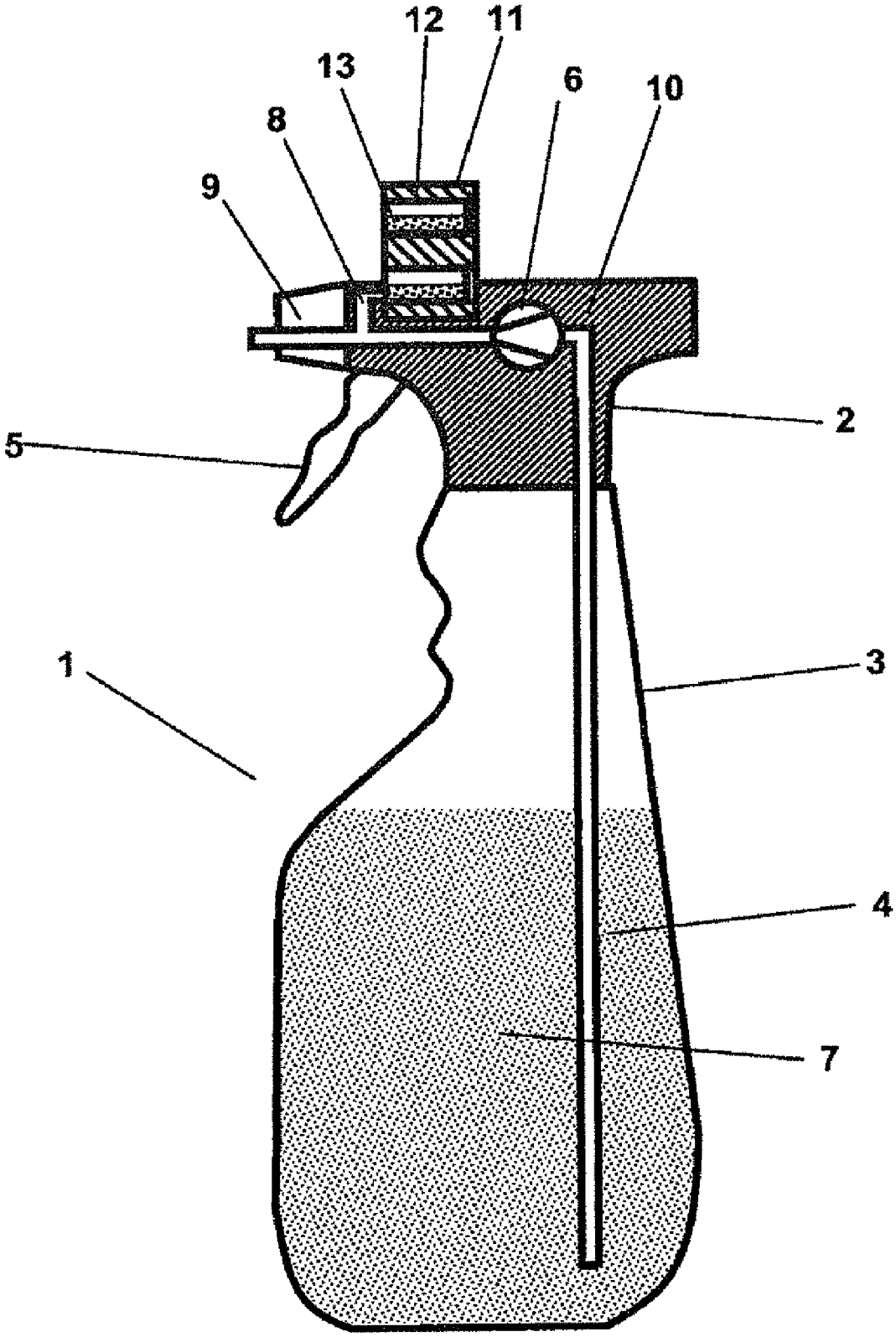
FIG. 4 Packaging means system with a receiving element for portion cartridges on the pressure side of the delivery element in the cross-sectional view.

The portion cartridges 12 are arranged in a receptacle means 11, which is embodied in a drum shape and is rotatably arranged in the trigger spray head 2 so that by rotation of the drum 11 a portion cartridge 12 is coupled to the connection 8 arranged on the intake side. As shown in FIG. 4, it is also conceivable to couple the receptacle means 11 and/or the portion cartridges 12 on a connection 8 arranged on the pressure side. In both cases, mixing of the preparation 13 takes place by means of the vacuum in the connection 8, which is brought about due to the flow to the intake line 10 and/or the pressure line 9.

Figure 5:
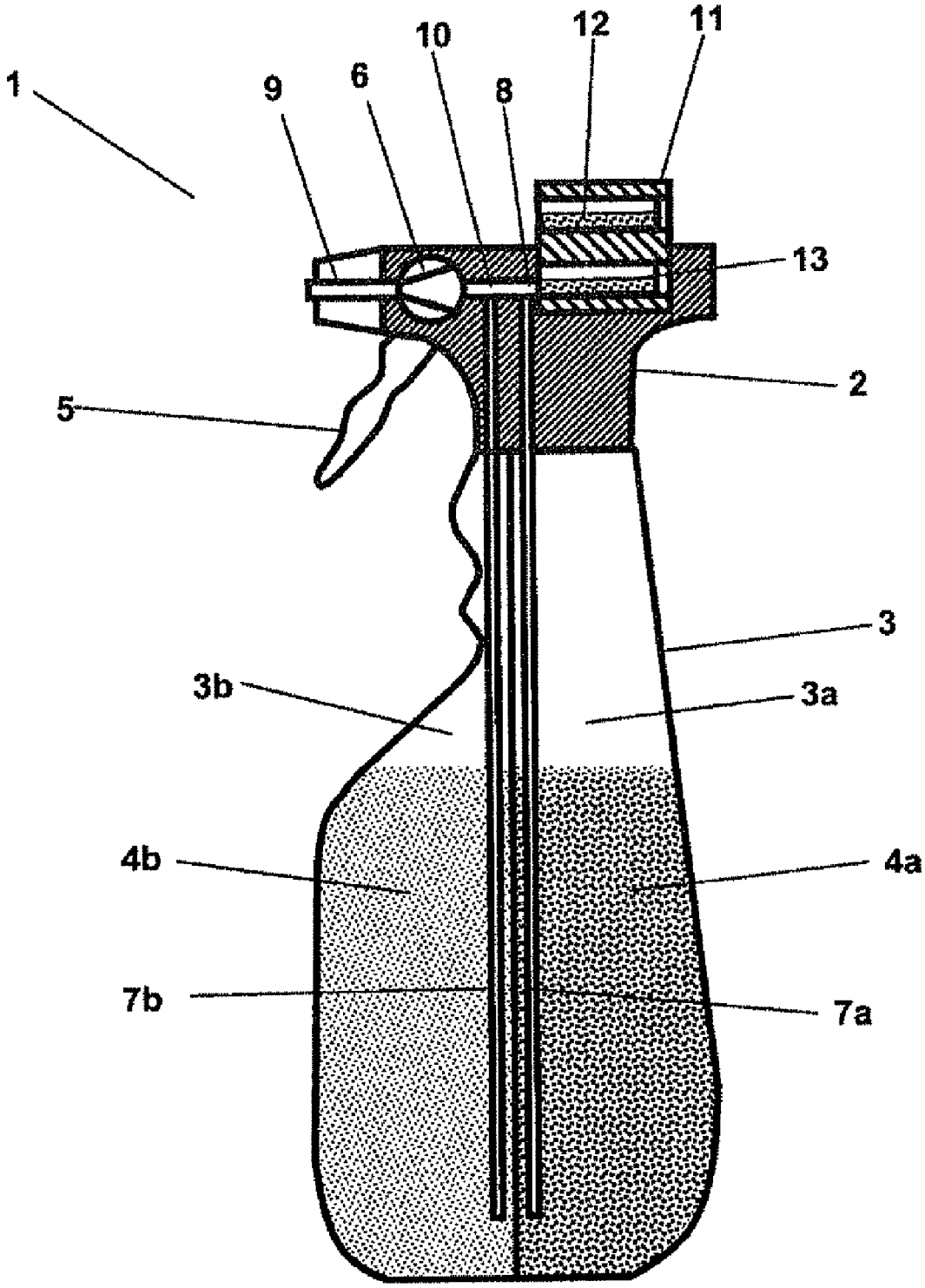
FIG. 5 Packaging means system with two-chambered bottle in the cross-sectional view.

As FIG. 5 discloses, the inventive dispensing device 2 may also be provided for use with multi-chambered containers. The bottle 3 has a first chamber 3*a* and a second chamber 3*b*, whereby the first chamber 3*a* is filled with a first preparation 4*a* and the second chamber 3*b* is filled with a second preparation 4*b*. A first ascending tube 7*a* and a second ascending tube 7*b* are each immersed in the respective chambers 3*a* and 3*b*. The ascending tubes 7*a* and 7*b* are connected to the intake line 10 communicatingly.

Figure 6:
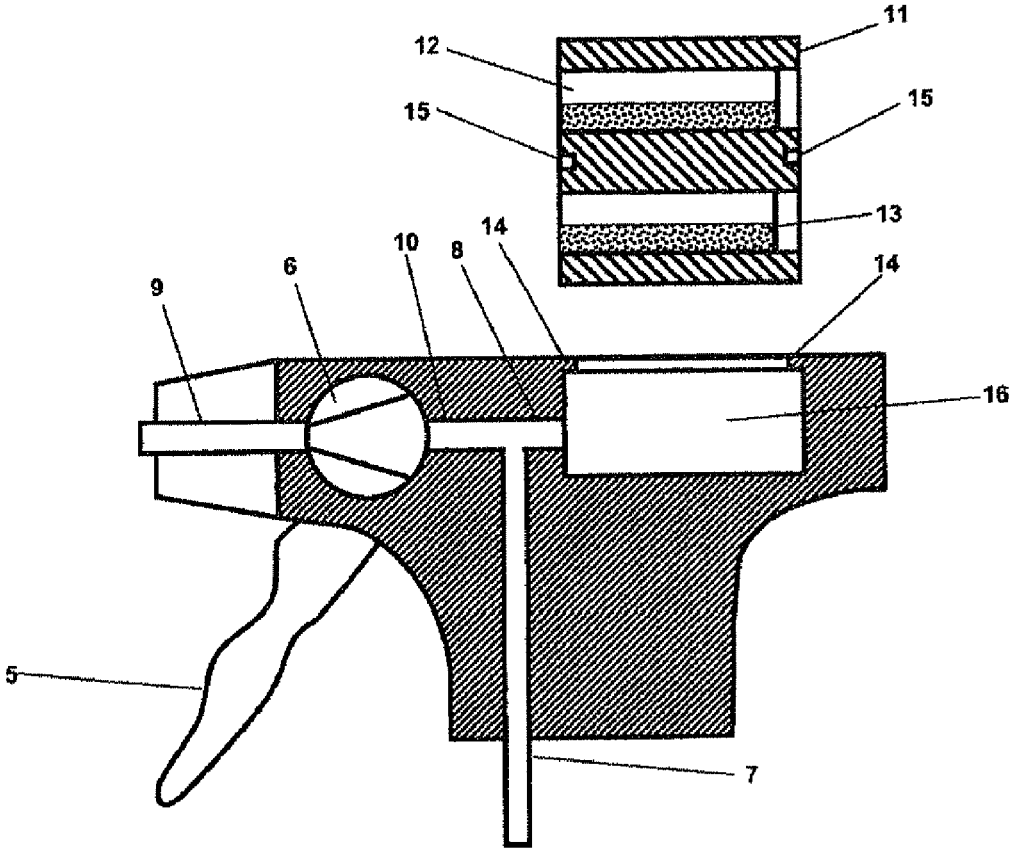
FIG. 6 Dispensing device with rotatably mounted receiving drum for portion cartridges in the cross-sectional view.

FIG. 6 shows the dispensing device 2 with a rotatably mounted receiving drum 11 for the portion cartridges 12 in a cross-sectional view. The dispensing device 2 has a receptacle 16 in which the receiving drum 12 can be positioned. On the end faces of the receptacle 16, opposing pins are shaped as axle elements 14, forming a rotatable connection with the bearings 15 of the portion cartridge 12. It is of course also conceivable for the axle elements 14 to be arranged on the portion cartridge 11 and for the bearing for receiving the axle elements 14 to be arranged on the receptacle 16 of the dispensing device 2.

Figure 8:
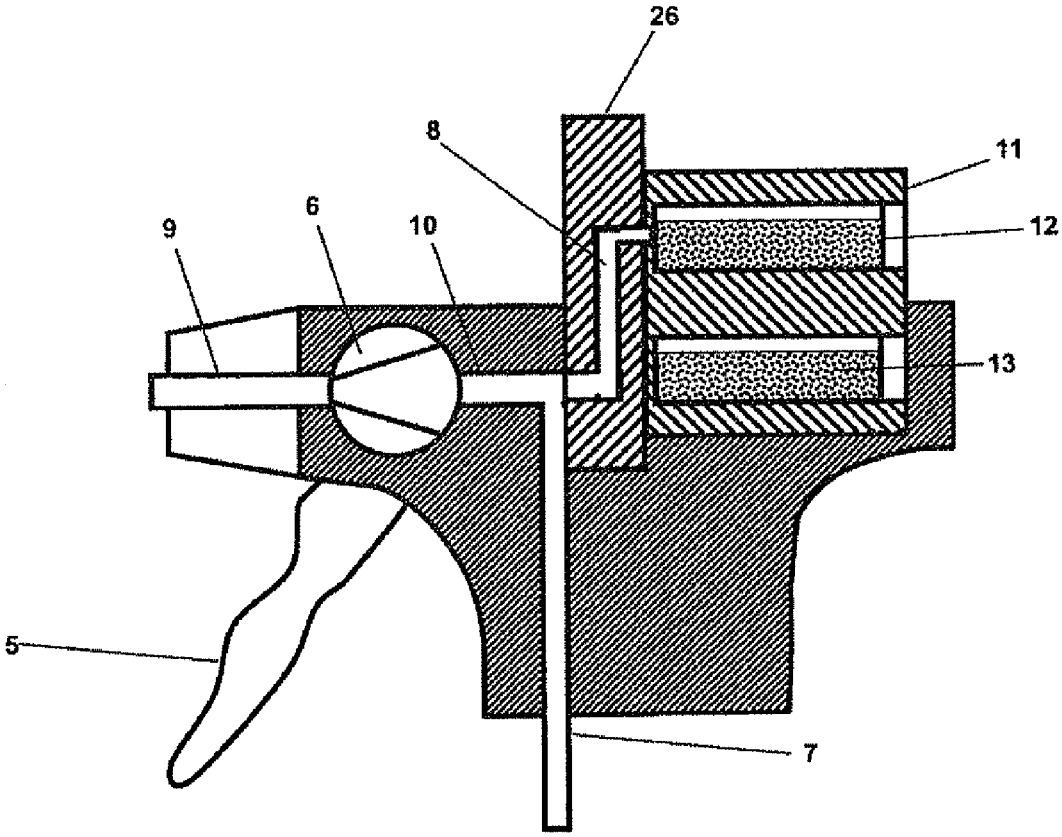
FIG. 8 Dispensing device with rotatably mounted control wheel in the cross-sectional view.

As shown in FIG. 8, it is also possible to secure the receptacle drum 11 rigidly in the receptacle 16 of the dispensing device 2 and to arrange the connection 8 in a control wheel 26 which is mounted rotatably with respect to the dispensing device, so that by rotating the control wheel 26, another portion cartridge 12 can be coupled to the connection 8.

Figure 9:
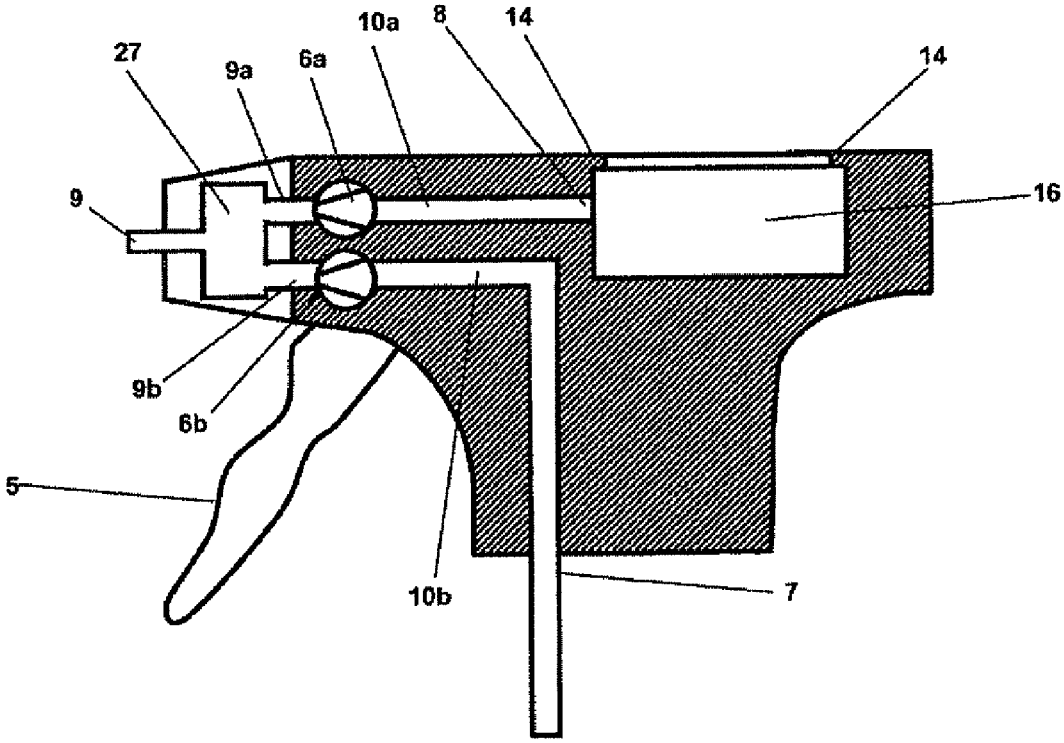
FIG. 9 Dispensing device with two separate delivery element and a mixing chamber in the cross-sectional view.

Another embodiment of the inventive dispensing device 2 is shown in FIG. 9. The dispensing device 2 here has two pumps 6*a*, 6*b*, the first pump 6*a* being connected by a first intake line 10*a* to the connection 8 and the second pump 6*b* being communicatingly connected by the second intake line 10*b* to the ascending tube 7.

Both pumps 6*a*, 6*b* are coupled to the operating element 5. On the pressure side of the pumps 6*a*, 6*b* the pressure lines 9*a*, 9*b* open into a joint mixing chamber 27 in which the fluid streams from the portion cartridge 12 and the packing means 3 are combined. A pressure line 9 connects the mixing chamber 27 to the environment.

Figure 10:
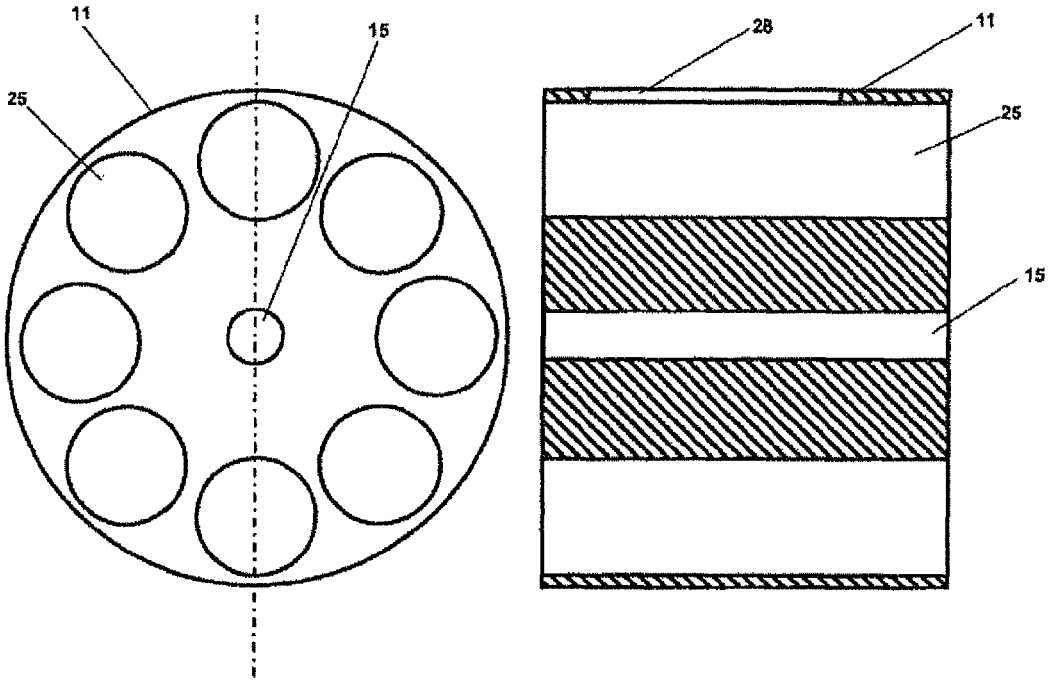
FIG. 10 Receiving drum for portion cartridges in the cross-sectional view.

A preferred embodiment of a receiving part 11 for portion cartridges 12 is the revolver-type receiving drum illustrated in FIG. 10. The receiving drum 11 is an essentially cylindrical body having cartridge chambers 25 arranged concentrically around the bearing 15 to receive the portion cartridges 12. For visual inspection of the filling level of the portion cartridges 12 arranged in the receiving drum 11, the outer lateral surface of the receiving drum may have transparent areas 28 or recesses.

Figure 11:
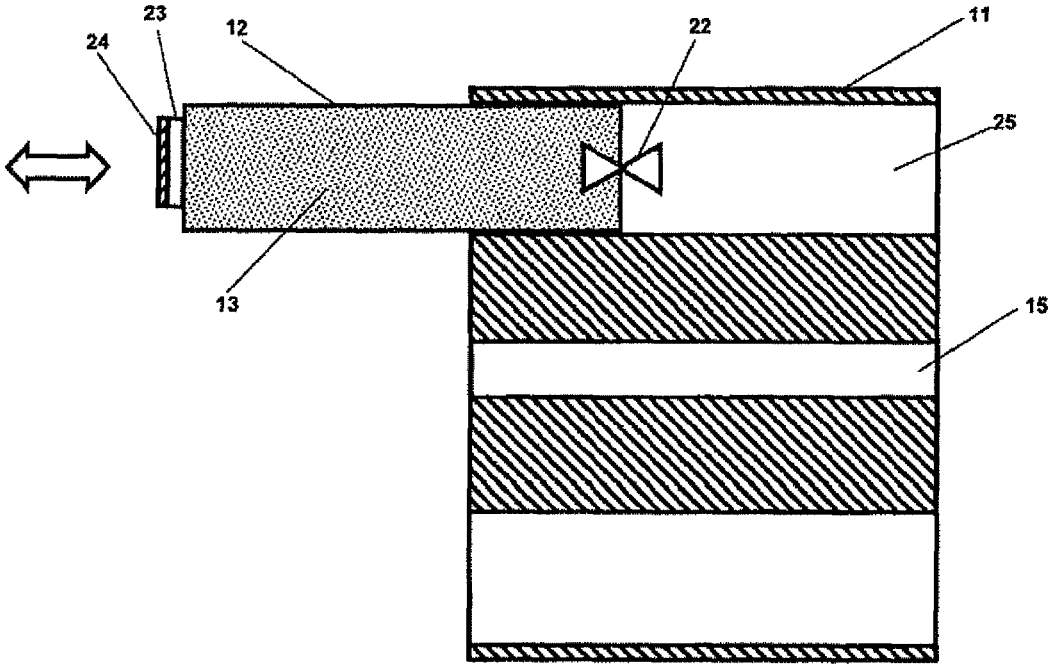
FIG. 11 Portion cartridge in receiving drum in the cross-sectional view.

FIG. 11 shows a portion cartridge 12 inserted into the receiving drum 11 and completely filled with a preparation 13. The portion cartridge 12 is detachably connected to the receiving drum 11. The cartridge 12 may in particular be secured in a form-fitting and/or non-positive manner in the cartridge chamber 25, thereby making it possible to replace a spent portion cartridge 12.

On an end face, the portion cartridge has a mouthpiece 23 through which the cartridge 12 is connectable to the connection 8 of the dispensing device. For equalizing the vacuum created by dispensing the preparation 13 in the portion cartridge, a vent valve is provided on the end face of the portion cartridge 12 opposite the mouthpiece.

The opening in the mouthpiece 23 is sealed by a closure 24. The closure 24 may be shaped as a diaphragm, for example, which is configured so that it breaks the vacuum created by the pump 6 in the connection 8, and the preparation 13 is delivered out of the portion cartridge 12. It is also conceivable to design the closure 24 as a silicone valve, which is opened by the vacuum mentioned above and closes again on reaching normal pressure.

Figure 12:
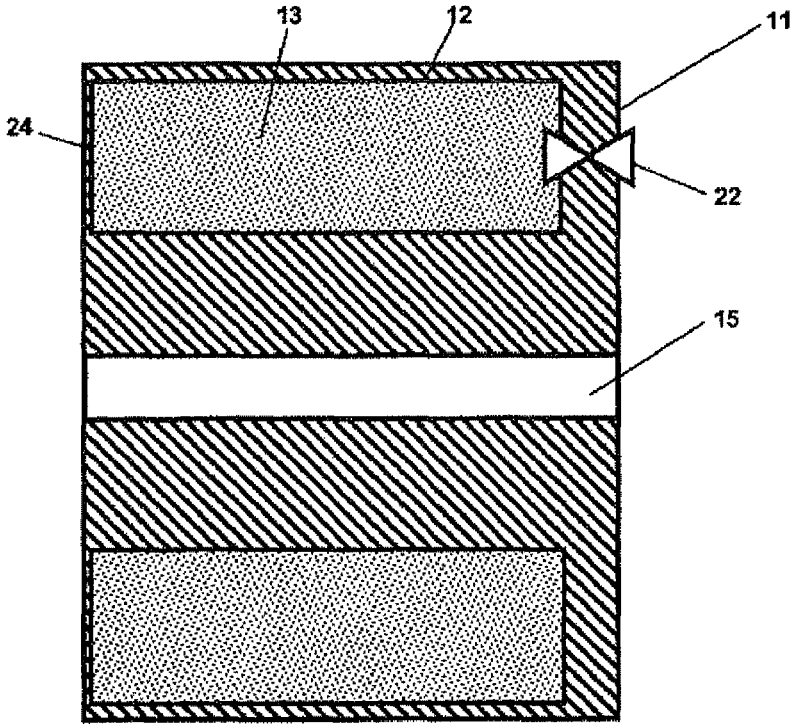
FIG. 12 Receiving drum with integrated portion cartridges in the cross-sectional view.
Figure 13:
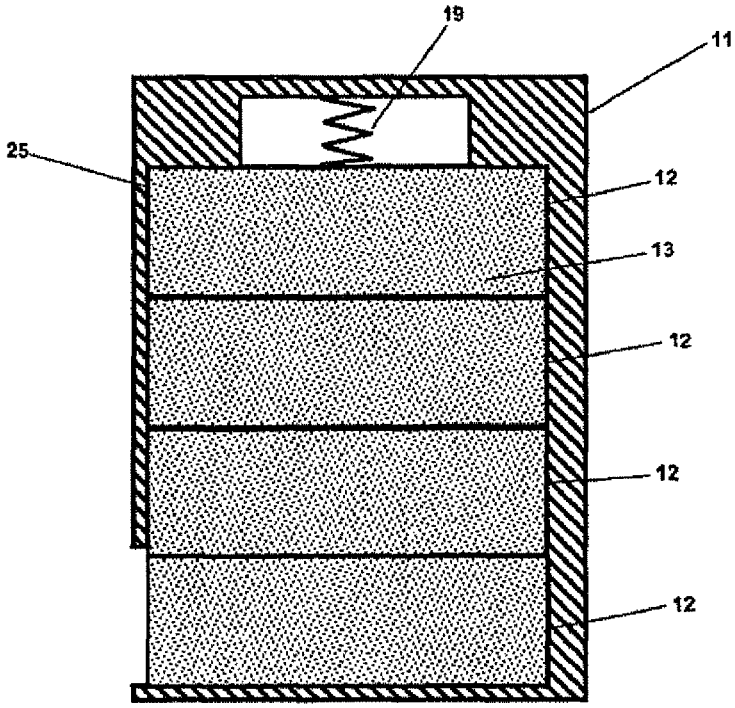
FIG. 13 Receiving magazine with portion cartridges in the cross-sectional view.

In addition to replacing individual portion cartridges 12 from the receiving drum, it is also conceivable, as shown in FIG. 12, to replace the entire receiving drum 11. To do so, the portion cartridges 12 are shaped by cavities in the receiving drum 11 and are thus undetachably connected to the receiving drum 11. The portion cartridges are sealed by a closure 24. For equalizing the pressure between the interior of the portion cartridge and the environment, the receiving drum 11 may have pressure equalizing valves 22.

Another embodiment of the receiving element 11 for the portion cartridges 12 is illustrated in FIG. 12. The portion cartridges 12 are not positioned here on a circular path concentric with the axis of rotation, as in the case of the receiving drum known from FIG. 10, but instead are arranged like a magazine one above the other.

Figure 14:
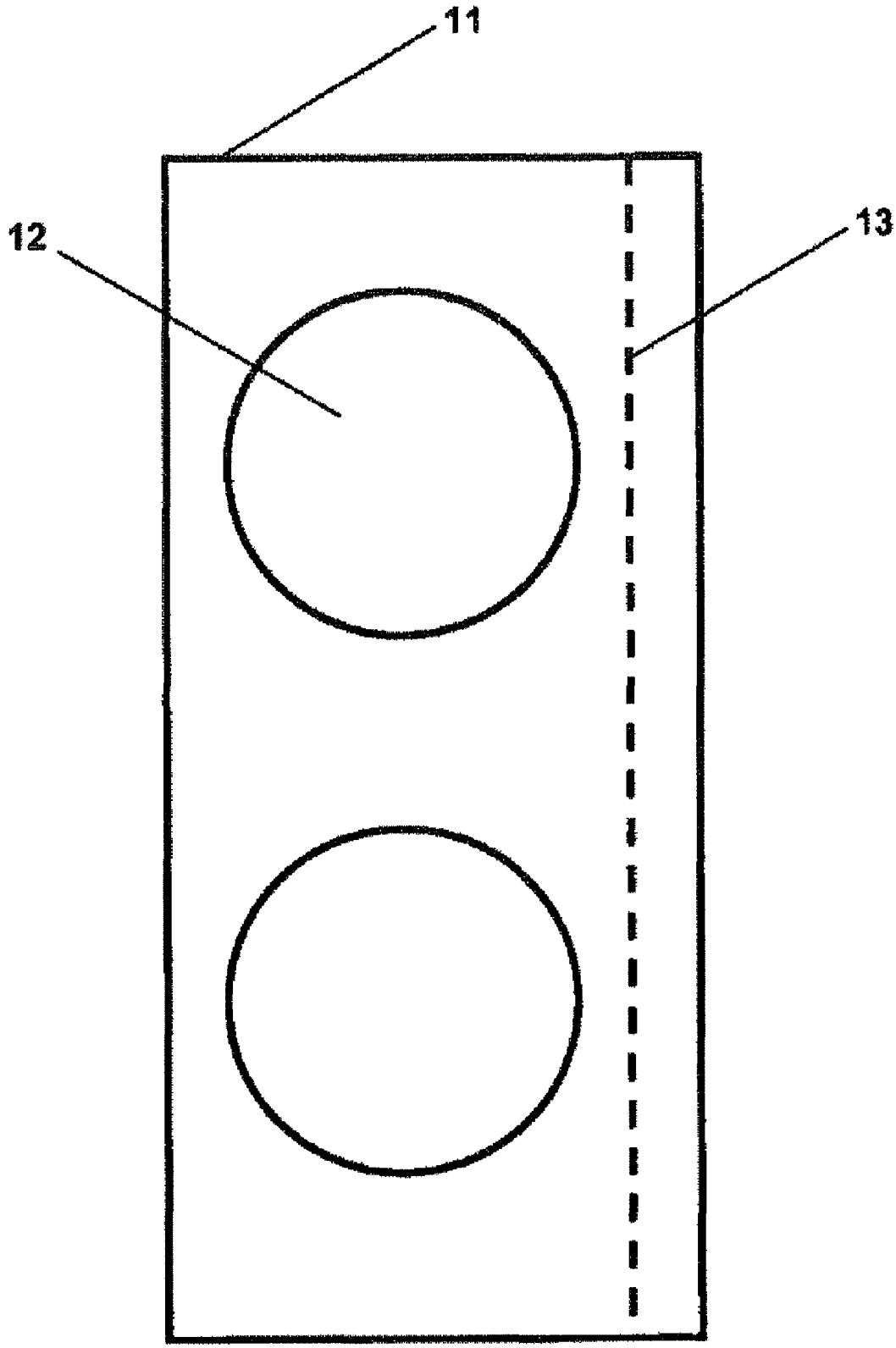
FIG. 14 Receiving blister with portion cartridges in the top view.

Furthermore, it is possible to design the receiving element 11 as a blister package, as shown in FIG. 14, in which case the portion cartridges 12 are embodied as cavities of the blister. To guide the blister package in the dispensing device, a perforation 13 may be provided on the edge of the blister package 13, such that a gearwheel of a conveyance and guidance mechanism of the dispensing device 2 engages with said perforation, the operation of the operating element 5 causing the release of the contents of a blister cavity 12 and the conveyance of an unused cavity of the blister package 11 to the connection 8.

Figure 15:
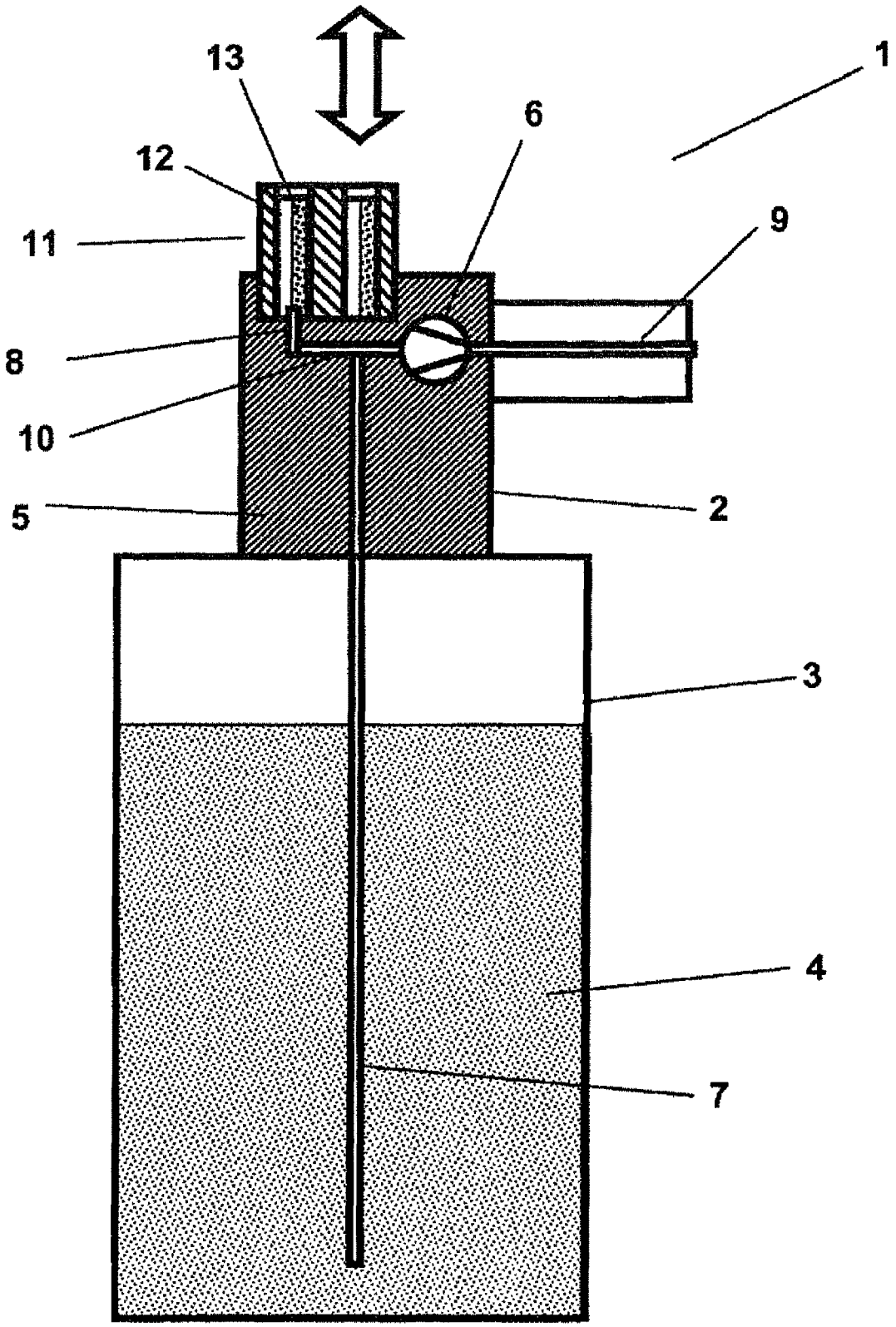
FIG. 15 Packaging means system with a receiving element for portion cartridges in a pump dispenser to be operated vertically in the cross-sectional view.

FIG. 15 shows a packaging means system 1 with a receiving drum 11 for portion cartridges 12 in a pump dispenser 5 to be operated vertically. Unlike the dispensing device known from FIG. 1, the pump is driven not by essentially horizontal operating kinematics but instead by vertical operating kinematics.

Such dispensing devices and configurations are known, for example, with soap dispensers or foam dispensers, where dispensing of the product is triggered by a vertical depression of the dispenser head.

The receiving drum 11 for the portion cartridges 12 is arranged to rotate vertically in the dispenser head 5 and moves with the dispenser head 5 when it is operated.

Figure 16:
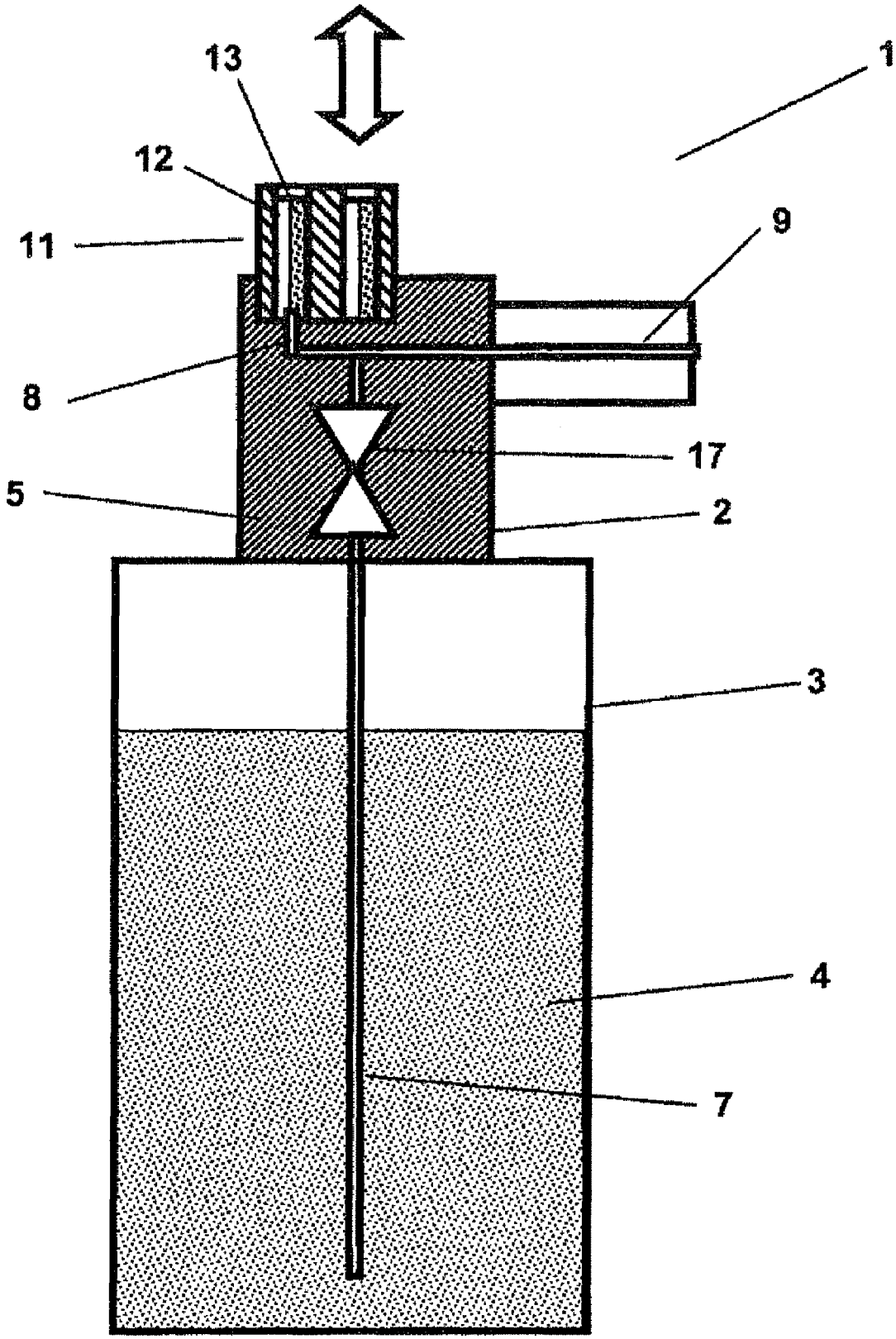
FIG. 16 Packaging means system with a receiving element for portion cartridges in an aerosol package in the cross-sectional view.

FIG. 16 shows an inventive dispensing device 2 for an aerosol package. The container 3 which is filled with a preparation 4 that is under pressure by a propellant is separated from the environment by a valve 17. By operating the dispenser head 5, the valve 17 is opened so that the preparation 4 which is under pressure is dispensed to the environment.

Figure 17:
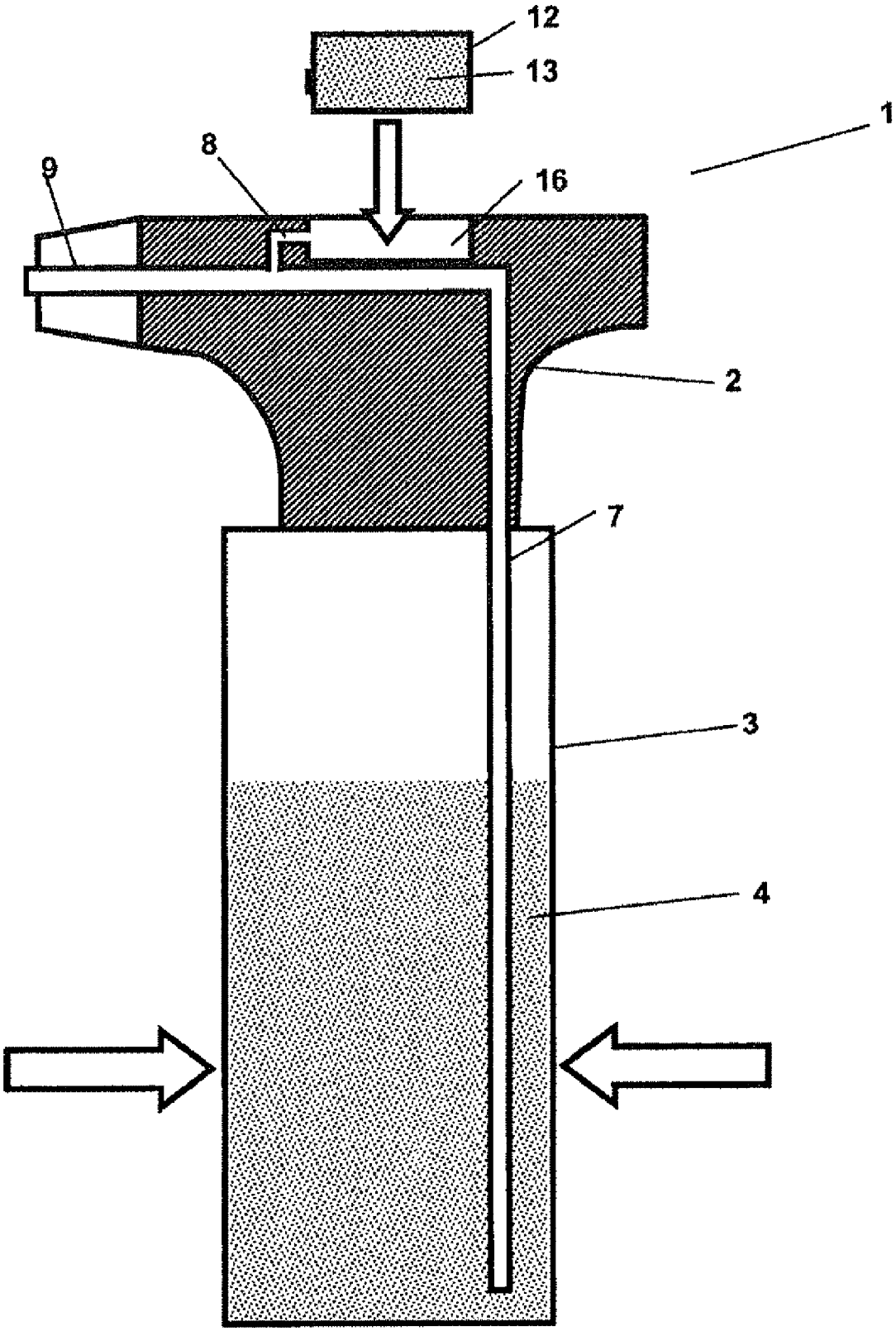
FIG. 17 Packaging means system with receiving shell for portion cartridges in a squeezable container in the cross-sectional view.

As an alternative to an aerosol package under pressure, it is also conceivable to create a pressure on the preparation 4 sufficient to release the product by squeezing a deformable container 3. An example of a corresponding configuration is illustrated in FIG. 17, where the dispensing device known from FIG. 1 and/or FIG. 2 is arranged on a container 3 that is preferably elastically deformable. The container 3 is embodied so that by compressing the lateral surface, which is indicated by the arrows in the figure, a pressure is created in the container 3, conveying the preparation 4 through the ascending tube 7 and the pressure line 7 into the environment and triggering at least partial dispensing of the preparation 13 in the fluid stream of the pressure line 9 in the case of a portion cartridge 12 secured in the receptacle 16 and connected to the connection 8. For use of the dispensing device 1 overhead, e.g. to administer the preparations 3, 14 beneath the edge of a toilet, the ascending tube 7 may also be embodied to be short, i.e, it does not protrude essentially out of the dispensing device 2 into the package 3.

While preferred embodiments of the invention have been described and illustrated here, various changes, substitutions and modifications to the described embodiments will become apparent to those of ordinary skill in the art without thereby departing from the scope and spirit of the invention.

LIST OF REFERENCE NUMERALS

1 packaging means system
2 dispensing device
3 packaging means
4 preparation
5 actuating element
6 delivery element
7 ascending pipe
8 connection
9 pressure line
10 intake line
11 receiving element
12 portion cartridges
13 preparation
14 axle element
15 bearing
16 receptacle
17 valve
18 valve
19 spring element
20 perforation
21 coupling element
22 aeration valve
23 mouthpiece
24 closure
25 cartridge chamber
26 control wheel
27 mixing chamber
28 inspection window

The invention claimed is:

1. A dispensing device (2) for dispensing essentially simultaneously at least two different preparations (4, 13) from a packaging means (3), comprising:

at least one delivery element (6) for delivery of a first preparation (4) out of the packaging means (3) into the environment, an actuating element (5) that is coupled to the delivery element (6), such that by operation of the actuating element (5), dispensing of at least the first preparation (4) out of the packaging means (3) is triggered, a connection (8) and an intake line (10) of the dispensing device (2) communicating with the delivery element (6), and a receiving element (11), coupled to the connection and the intake line, defined within the dispensing device to receive and position within the dispensing device a plurality of portion cartridges (12), at least one of said portion cartridges containing a second preparation (13), which is different from the first preparation (4) in the packaging means (3), the connection and the at least one portion cartridge being detachably connectable, such that operation of the actuating element (5) triggers dispensing of the first preparation (4) and the second preparation (13).

2. The dispensing device according to claim 1, wherein the portion cartridges (12) and the connection (8) are arranged so they are movable opposite from one another in the dispensing device (2), such that different portion cartridges (12) can be connected to the connection (8).

3. The dispensing device according to claim 2, wherein the receiving element (11) for receiving the portion cartridges (12) is movable with respect to the connection (8).

4. The dispensing device according to claim 3, wherein the receiving element (11) for receiving the portion cartridges (12) is rotatable with respect to the connection (8).

5. The dispensing device according to claim 2, wherein the connection (8) is movable with respect to the receiving element (11) for receiving the portion cartridges (12).

6. The dispensing device according to claim 5, wherein the connection (8) is rotatable with respect to the receiving element (11) for receiving the portion cartridges (12).

7. The dispensing device according to claim 2, wherein the dispensing device (2) comprises a coupling element (21) that is coupled to the actuating element (5) and is configured so that the operation of the actuating element (5) moves the portion cartridges (12) and the connection (8) toward one another, such that a first portion cartridge is removed from the connection (8) and a second portion cartridge is connected to the connection (8).

8. The dispensing device according to claim 2, wherein the connection (8) is embodied such that a plurality of portion cartridges (12) is simultaneously connectable to the connection (8).

9. The dispensing device according to claim 2, wherein the receiving element (11) comprises a plurality of chambers (2) to receive portion cartridges (12).

10. The dispensing device according to claim 9, wherein the receiving element (11) has a drum shape.

11. The dispensing device according to claim 9, wherein the receiving element (11) is configured as a blister package.

12. The dispensing device according to claim 2, wherein the receiving element (11) comprises a chamber (2) to receive the plurality of portion cartridges (12).

13. The dispensing device according to claim 1, wherein the portion cartridges (12) in relation to the packaging means (3) have a volume ratio between 1:5000 and 1:20.

14. The dispensing device according to claim 1, wherein each portion cartridge (12) comprises a closure (24) which is embodied such that at least a portion of the preparation (13) is dispensed from the portion cartridge (12) due to the vacuum created in the connection (8) by operation of the delivery element (6) and the vacuum created by the flow in the intake line (10) or the pressure line (9).

15. The dispensing device according to claim 1, wherein each portion cartridge (12) is dimensionally stable.

16. The dispensing device according to claim 1, wherein each portion cartridge (12) comprises a vent valve (22).

17. The dispensing device according to claim 1, wherein the packaging means (3) is dimensionally stable.

18. The dispensing device according to claim 1, wherein the packaging means (3) is shaped as an elastically squeezable bottle.

19. The dispensing device according to claim 1, wherein the packaging means (3) is an aerosol container.

20. The dispensing device according to claim 1, wherein the second preparation (13) comprises at least one additive substance selected from the group consisting of: fragrances, bleaching agents, cleaning substances, solvents, surfactants, dyes, enzymes, hygroscopic substances, flame retardants, hardeners, flow control agents, wetting agents, dispersants, foaming agents, foam suppressants, deaerators, anticorrosion agents, biocides, water softeners, preservatives, emulsifiers, stabilizers, vitamins, and minerals.

21. A dispensing device (2) for dispensing essentially simultaneously at least two different preparations (4, 13) from a packaging means (3), comprising:

at least one delivery element (6) for delivery of a first preparation (4) out of the packaging means (3) into the environment, an actuating element (5) that is coupled to the delivery element (6), such that by operation of the actuating element (5), dispensing of at least the first preparation (4) out of the packaging means (3) is triggered, a connection (8) and an intake line (10) of the dispensing device (2) communicating with the delivery element (6), and a receptacle (16), coupled to the connection and the intake line, defined within the dispensing device to receive and position within the dispensing device at least one portion cartridge (12) containing a second preparation (13), which is different from the first preparation (4) in the packaging means (3), the connection (8) and the at least one portion cartridge being detachably connectable, such that operation of the actuating element (5) triggers dispensing of the first preparation (4) and the second preparation (13), wherein the receptacle (16) comprises a plurality of axle elements (14) configured to form a rotatable connection with the portion cartridge (12).

* * * * *